US007132630B2

(12) United States Patent
Qi et al.

(10) Patent No.: US 7,132,630 B2
(45) Date of Patent: Nov. 7, 2006

(54) RESISTIVE HEATING USING POLYANILINE FIBER

(75) Inventors: Baohua Qi, Albuquerque, NM (US); Benjamin R. Mattes, Santa Fe, NM (US)

(73) Assignee: Sante Fe Science and Technology, LLC, Santa Fe, NM (US)

( * ) Notice: Subject to any disclaimer, the term of this patent is extended or adjusted under 35 U.S.C. 154(b) by 120 days.

(21) Appl. No.: 10/727,025

(22) Filed: Dec. 2, 2003

(65) Prior Publication Data

US 2004/0144772 A1 Jul. 29, 2004

Related U.S. Application Data

(60) Provisional application No. 60/430,728, filed on Dec. 2, 2002.

(51) Int. Cl.
*H05B 3/54* (2006.01)

(52) U.S. Cl. ..... 219/545; 219/529; 219/544; 428/480; 264/103

(58) Field of Classification Search ..... 219/544, 219/545, 529; 252/500, 519; 428/480; 264/103, 264/210.6
See application file for complete search history.

(56) References Cited

U.S. PATENT DOCUMENTS

| | | | | |
|---|---|---|---|---|
| 4,792,662 | A * | 12/1988 | Kitagaki et al. | 219/545 |
| 5,171,478 | A * | 12/1992 | Han | 252/500 |
| 5,176,851 | A * | 1/1993 | Barry, Jr. | 252/500 |
| 5,188,766 | A * | 2/1993 | Eiffler | 252/500 |
| 5,422,462 | A * | 6/1995 | Kishimoto | 219/545 |
| 5,629,665 | A | 5/1997 | Kaufmann et al. | |
| 5,656,709 | A * | 8/1997 | Fukushima et al. | 528/9 |
| 5,882,566 | A * | 3/1999 | Hsu et al. | 264/210.6 |
| 6,033,939 | A | 3/2000 | Agarwala et al. | |
| 6,074,576 | A | 6/2000 | Zhao et al. | |
| 6,541,744 | B1 * | 4/2003 | Von Arx et al. | 219/544 |
| 6,548,789 | B1 * | 4/2003 | Rock et al. | 219/545 |
| 2003/0091845 | A1 * | 5/2003 | Pron et al. | 428/480 |
| 2004/0045955 | A1 * | 3/2004 | Rock et al. | 219/529 |
| 2004/0119187 | A1 * | 6/2004 | Mattes et al. | 264/103 |
| 2004/0162397 | A1 * | 8/2004 | Lee et al. | 525/420 |

FOREIGN PATENT DOCUMENTS

| | | | |
|---|---|---|---|
| WO | WO 99/24991 | | 5/1999 |
| WO | WO 9924991 | * | 5/1999 |

OTHER PUBLICATIONS

PCT Search Report dated Sep. 2, 2004.

* cited by examiner

*Primary Examiner*—Robin O. Evans
*Assistant Examiner*—Leonid Fastovsky
(74) *Attorney, Agent, or Firm*—Samuel M. Freund; Cochran Freund & Young LLC

(57) ABSTRACT

The use of conductive polyaniline fibers for resistive heating applications is described. Unlike metal wires and conductive-polymer coated fibers, under certain conditions, electric voltages or currents used to generate heat in the fibers were found to produce irreversible changes to the polymer backbone that destroy its electrical conductivity but not its structural integrity. The temperature that these changes occur varies with dopant and fiber diameter, and can be tailored to specific applications. Since these changes occur at lower temperatures than the temperature at which dopant molecules within the conductive polymer are lost or decomposed, both of which lower the conductivity of the material, polyaniline fibers can be used for resistive heating applications where the heating element is in the vicinity of the skin of the wearer thereof.

23 Claims, 20 Drawing Sheets

RESISTIVE HEATING USING POLYANILINE FIBER

RELATED CASES

The present patent application claims the benefit of Provisional Patent Application Ser. No. 60/430,728 filed on Dec. 02, 2002 for "Resistive Heating Using Polyaniline Fiber."

STATEMENT REGARDING FEDERAL RIGHTS

This invention was made in part with government support under Contract No. MDA972-99-C004 awarded by the U.S. Defense Advanced Research Projects Agency to Santa Fe Science and Technology, Inc., Santa Fe, N.Mex. 87507. The government has certain rights in the invention.

FIELD OF THE INVENTION

The present invention relates generally to polymeric fibers and, more particularly, to the use of polyaniline fibers for resistive heating applications.

BACKGROUND OF THE INVENTION

Heating garments using resistive wires such as stainless steel, nickel-based alloys or carbonized yarn arranged in a chosen pattern on an electrically insulating backing material as heating elements have found extensive use in heated socks, gloves, jackets, pants, boots, and blankets, as examples. However, such wires are known to have poor flexibility and poor tolerance to frequent bending and contact. Moreover, incompatibility between the expansion properties of the wires and those for the backing material exacerbates these problems.

Sources of electrical energy used to activate such heating garments require controllers to regulate the temperature and to prevent runaway heating thereof. However, in the event that such controllers fail or the resistance of the garment changes rapidly from an electrical short or other situation where the resistance greatly increases, localized heating can cause burns to the wearer.

Phillip Norman Adams et al. in "Conductive Polymer Compositions,"International Publication No. WO 99/24991, which was published on 20 May 1999, teach the synthesis of polyaniline fibers from a solution of polyaniline (~150,000 g/mol), and 2-acrylamido-2-methyl-1-propanesulfonic acid (AMPSA) (60 AMPSA molecules per hundred nitrogen atoms in the polyaniline backbone) in dichloroacetic acid. As-spun conductivities for these polymers were found to be between 70±9 S/cm and 90±8 S/cm, when the fiber is spun into butyl acetate and acetone, respectively. Conductivities and tensile strengths were measured to be 810±200 S/cm and 45 MPa, and 1014±200 S/cm and 60 MPa, when the fiber was subsequently stretched to between 5 and 8 times its original length, respectively.

In U.S. Pat. No. 5,422,462 for "Electric Heating Sheet" which issued to Yoshio Kishimoto on Jun. 06, 1995, a unidirectionally conductive electric heating sheet which includes conductive yarns and wires having insulating properties at least on their surfaces that are plain-woven as warps and wefts such that neighboring conductive yarns are not in electrical contact, is described. A list of synthetic polymeric organic fibers currently used in the garment industry is provided as yarn material. These fibers are covered with a conductive layer which includes conductive polymers such as polypyrrole, polythiophene and polyanline, or metals having low melting points. It is stated that the conductive yarn can lose its continuity after breaking its conductive covering layer due to sparks or by overheating. In another embodiment described in the '462 patent, a conductive wire having an insulating layer of thermoplastic polymer on the surface is woven with conductive yarn. When the insulating layer melts as a result of overheating, the conductive yarns and the conducting wires short-circuit and melt, thus functioning as a thermal fuse element. It is clear from this disclosure that the heating sheet cannot be used close to a wearer's skin.

In U.S. Pat. No. 6,074,576 for "Conductive Polymer Material For High Voltage PTC Devices" which issued to Liren Zhao and Prasad S. Khadkikar on Jun. 13, 2000, polymeric positive temperature coefficient (PTC) compositions and electrical devices having a high voltage capability which are capable of operating at alternating current voltages of 110 to 130 volts or greater are described. The PTC compositions disclosed were found to have a high PTC effect of at least $10^4$ to $10^5$ and a low initial resistivity at 25° C. of 100 Ωcm or less. The devices were designed as self-resetting sensors for AC motors to protect these motors from over-heating and/or over-current surges, and can withstand a voltage of 110 to 130 VAC without failure for at least 4 h after reaching the switching temperature, $T_s$. Such materials include a crystalline or semicrystalline polymer, a particulate conductive filler, an inorganic additive and, optionally, an oxidant. It is known that the $T_s$ of a conductive polymeric composition is generally below the melting point, $T_m$, which is chosen to be between 100° C. and 200° C. Therefore, once an electrical current sufficient to heat the PTC device is applied thereto, the device retains its electrical and thermal stability after attaining its high electrical resistance at near $T_m$.

U.S. Pat. No. 6,033,939 for "Method For Providing Electrically Fusible Links In Copper Interconnection" which issued to Birenda N. Agarwala et al. on Mar. 7, 2000 describes methods for fabricating fuses within a semiconductor IC structure, where the fuses are deletable by a laser pulse or by a low-voltage electrical pulse typically below 3.5 V, and are usable to reroute the electrical circuitry of the structure to remove a faulty element. Although the preferred fuse material is silicon-chrome-oxygen and the preferred circuitry is copper, polymers including polyanilines having electrical resistivity in the range between 15 micro-ohm-cm and 90 micro-ohm-cm, are used for the fuse material, since such materials can be spun onto the surface. The heat generated by passing an electric current through the fuse to delete it oxidizes the polyanilines, thereby giving an oxidized material having a very high resistance. The highly resistive, oxidized polyaniline changes color, thereby offering a detector for the changed resistivity. The thin-film fuses are formed using photolithography and etching techniques.

U.S. Pat. No. 5,629,665 for "Conducting-Polymer Bolometer" which issued to James Kaufmann et al. on May 13, 1997 describes an ion-implanted, electrically conductive polymer bolometer fabricated using lithographic techniques. In response to incident infrared radiation, the electrical resistance of the polymer changes. This change can be monitored using a bridge circuit. The polymer film is deposited using spin coating, roller coating or meniscus coating techniques.

It is an object of the present invention to provide conductive-polymer based heating elements suitable for resistive heating applications.

Another object of the present invention is to provide conductive-polymer based resistive heating elements having the light weight, stretchability, flexibility and processability characteristic of commonly used textile fibers.

Yet another object of the present invention is to provide conductive-polymer based resistive heating elements which cannot achieve temperatures sufficiently high to harm a user of a heating apparatus fabricated therefrom.

Additional objects, advantages and novel features of the invention will be set forth, in part, in the description that follows, and, in part, will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects of the present invention, and in accordance with its purposes, as embodied and broadly described herein, the heating apparatus hereof includes a resistive heating element comprising conductive polyaniline fiber or conductive polyaniline yarn comprising conducting polymer fiber; and means for passing a voltage or a current through the heating element.

In another aspect of the present invention and in accordance with its objects and purposes, the conductive polyaniline fiber suitable for resistive heating hereof is characterized by an as-spun conductivity of ≧100 S/cm and an as-spun peak stress ≧75 MPa.

Benefits and advantages of the present invention include light, strong and flexible polyaniline fiber for resistive heating applications. Additionally, under certain conditions, electric currents used to generate heat in the fibers produce irreversible changes to the polymer backbone that significantly destroy its electrical conductivity without substantially affecting the structural properties of the fiber at lower temperatures than dopants within the conductive fiber are lost/decomposed. As a result, the heating elements of the present invention find use in applications where the heating elements are placed in the vicinity of a user thereof.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION

Figure 1:
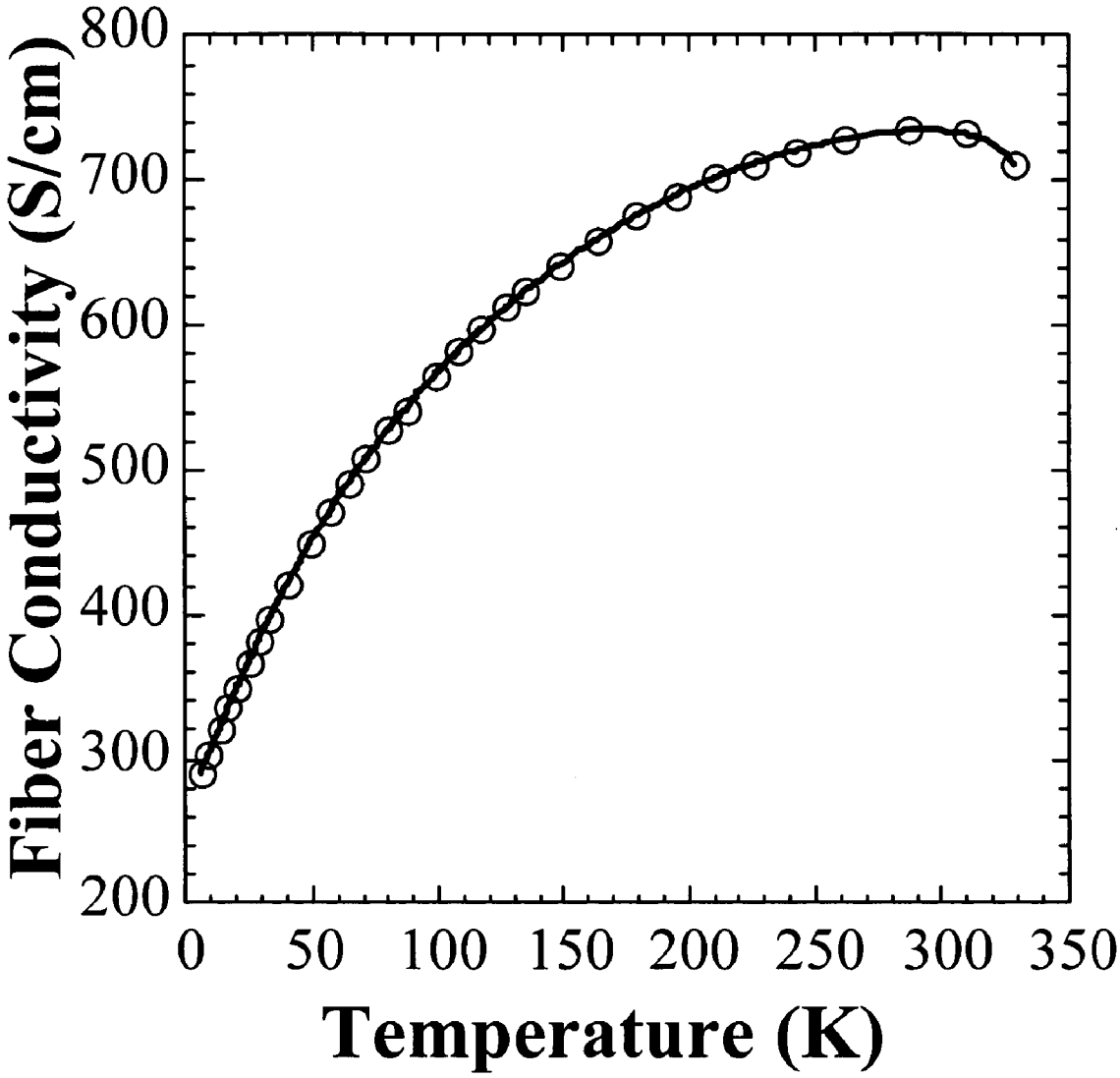
FIG. 1 is a graph of fiber conductivity as a function of temperature for the conductive polyaniline fiber of the present invention.

Briefly, the present invention includes the use of conductive PANI.AMPSA$_{0.6}$ fibers for resistive heating applications. Fibers were spun from a solution of a mixture of a chosen amount of polyaniline powder with 2-acrylamido-2-methyl-1-propanesulfonic acid (AMPSA) in dichloracetic acid (DCAA). Subsequent to spinning, the fibers were partially ion exchanged using phosphoric acid and then stretched, or stretched and dedoped and redoped with selected dopants.

Electrical current-induced destruction of conductivity for polyaniline fibers resulting from the application of a current characteristic of a particular conductive polyaniline fiber has been observed at temperatures lower than the temperature at which dopant molecules in the conductive polymer are lost or decompose, or the temperature at which the polyaniline backbone decomposes. The temperature at which this effect occurs is dependent on the dopant and on the fiber diameter. Polyaniline fibers may therefore be used for resistive heating applications where the heating element is in the vicinity of the skin of a wearer thereof. It was also observed that when the electrical conductivity of the fiber has been substantially destroyed, the structural integrity of the fiber is preserved.

Weaves and woven structures can be used for resistive heating fabrics, as can yarns having conductive polyaniline fibers incorporated therein. There are three basic types of weaves: plain, twill and satin. All variations may include elements of one or more basic weaves in each cloth. In a plain weave, the threads interlace in alternate order, and if the warp and weft threads are similar in thickness and number per unit space, the two series of threads bend about equally. The twill order of interlacing causes diagonal lines to be formed in the cloth. These weaves are employed for the purpose of ornamentation and to enable a cloth of greater weight, close setting, and better draping quality to be formed than can be produced in similar yarns in plain weave. In satin weaves, the surface of the cloth consists almost entirely either of weft or warp float, as in the repeat of a weave each thread of one series passes over all but one thread of the other series. Satin weaves have a maximum degree of smoothness and luster, and without any prominent weave features.

Woven structures can be divided into two principal categories as simple structures or compound structures. In the simple structures, the ends (warp) and the picks (weft) intersect one another at right angles and in the fabric are respectively parallel with each other. In these constructions, there is only one series of ends and one series of picks, and all the constituent threads are equally responsible for both the utility or performance of a fabric and its aesthetic appeal. The compound structures may have more than one series of ends or picks, some of which may be responsible for the "body" of the fabric, such as ground yarns, while some may be employed entirely for ornamental purposes such as "figuring" or "face" yarns. In these cloths, some threads may be found not to be in parallel formation one to another in either plane and, indeed, there are may pile surface constructions in which some threads may project out at right angles to the general plane of the fabric.

Knitted fabrics can also be used for resistive heating applications, where the knitted fibers or yarns contain conductive polyaniline fibers and/or the conductive polyaniline fibers are interlaced into a non-conductive knitted fabric.

Fabrics used as resistive heating elements include any of the above-described fabrics made entirely using conductive polyaniline fiber or yarn produced from conductive polyaniline fiber, as well as fabrics made of non-conductive materials interlaced or interwoven with conductive polyaniline fiber or yarn, and combinations thereof. Other articles suitable for heating applications include conductive polyaniline fibers or yarns produced from conductive polyaniline fiber supported in a non-conductive substrate. Conductive polyaniline fibers can be used in either the weft and/or the warp of a woven fabric, the conductive fibers being present in the yarn used to make the woven fabric and/or interlaced with other fibers.

Electrical connections to the heating elements may be accomplished in a number of well-known ways including conductive metal paints and epoxies, conductive Velcro straps, and mechanical connections. Power sources include both ac and dc electrical sources. Such sources comprise batteries, and electrical power supplies and further include electrical constant current and/or constant voltage power supplies.

As will be demonstrated hereinbelow, non-conductive polyaniline fiber can be made conductive by doping the fibers with suitable dopants. Therefore, yarns, fabrics and other articles can be made conductive, and thereby suitable for resistive heating applications, subsequent to being produced from non-conductive polyaniline fiber.

Thermal characteristics of the doped polyaniline fiber were investigated under applied constant current and constant voltage situations. It was found that the temperature change of the conductive polymer fiber is proportional to the square of the voltage applied to the fiber, or to the square of the current passed through the fiber. The proportionality coefficients are determined by the specific heat of the conductive polymer fiber and the nature of the environment surrounding the conductive polymer fiber. For the same current or voltage input, the larger the proportionality coefficient, the higher the final temperature that can be obtained. The proportionality coefficient under vacuum was found to be about 11 times larger than that observed under ambient conditions.

It has been calculated that the maximum power deliverable by a length of conductive polyaniline fiber increases with increasing fiber diameter.

A. Representative Synthesis of High Molecular-Weight, Halogen-Free Polyaniline:

Water (6,470 g) was first added to a 50 L jacketed reaction vessel fitted with a mechanical stirrer. Phosphoric acid (15,530 g) was then added to the water, with stirring, to give a 60 mass % phosphoric acid solution. Aniline (1,071 g, 11.5 moles) was added to the reaction vessel over a 1 h period by means of a dropping funnel in the top of the reaction vessel. The stirred aniline phosphate was then cooled to 238 K (−35.0° C) by passing a cooled 50/50 by mass, methanol/water mixture through the vessel jacket. The oxidant, ammonium persulfate (3,280 g, 14.37 moles) was dissolved in water (5,920 g), and the resulting solution was added to the cooled, stirred reaction mixture at a constant rate over a 30 h period. The temperature of the reaction mixture was maintained at 238±1.5 K (−35.0±1.5° C.) during the duration of the reaction to ensure good product reproducibility between batches.

The reactants were typically permitted to react for 46 h, after which the polyaniline precipitate was filtered from the reaction mixture and washed with about 25 L of water. The wet polyaniline filter cake was then mixed with a solution of 800 cc of 28% ammonium hydroxide solution mixed with 20 L of water and stirred for 1 h, after which the pH of the suspension was 9.4.

The polyaniline slurry was then filtered and the polyaniline filtrate washed 4 times with 10 L of water per wash, followed by a washing with 2 L of isopropanol. The resulting polyaniline filter cake was placed in plastic trays and dried in an oven at 35° C. until the water content was below 5 mass %. The recovered mass of dried polyaniline was 974 g (10.7 moles) corresponding to a yield of 93.4%. The dried powder was sealed in a plastic bag and stored in a freezer at 255 K (−18° C.). The weight average molecular weight ($M_w$) of the powder was found to be 280,000 g/mol, although $M_w$ values between about 100,000 and about 350,000 g/mol have been obtained using this synthesis by controlling the reaction temperature between 273 and 238 K (between 0 and −35° C.), respectively. Gel permeation chromatograph (GPC) molecular weight data was obtained using a 0.02 mass % solution of EB in NMP containing 0.02 mass % lithium tetrafluoroborate. The flow rate of the solution was 1 mL ·min.$^{-1}$, and the column temperature was 333 K (60° C.). The Waters HR5E column utilized was calibrated using Polymer Labs PS1 polystyrene standards, and the polymer eluted from the GPC column was detected using a Waters 410 refractive index detector coupled with a Waters 996 UV-Vis photodiode array.

The concentration of phosphoric acid was chosen in order to prevent the reaction mixture from freezing at low temperatures. Sulfuric acid, formic acid, acetic acid, difluoroacetic acid, and other inorganic and organic acids have either been found to be or are expected to be suitable as well. Since the aniline polymerization reaction is exothermic, to ensure good product reproducibility between batches, the temperature is controlled to keep any exotherm less than a few degrees.

Although this synthesis was used for the polyaniline spinning solutions set forth hereinbelow, polyaniline can be prepared by any suitable method; as examples, chemical polymerization of appropriate monomers from aqueous solutions, mixed aqueous and organic solutions, or by electrochemical polymerization of appropriate monomers in solutions or emulsions.

B. Preparation of Solutions having PANI.AMPSA$_{0.6}$ in DCAA, and Spinning thereof:

Although spin solutions were prepared using PANI-EB having a weight average molecular weight ($M_w$) of ~300,000 g/mol, fibers have been successfully produced using polyaniline having weight average molecular weights between about 90,000 and about 350,000 g/mol (defined as high molecular weight polyaniline herein). The use of higher molecular weight polyaniline enables the fibers to survive greater stretch ratios in the spin line without breaking. High stretch ratios are important for obtaining fibers having high electrical conductivity, high modulus and high peak stress.

The PANI-EB powder was dried to achieve desired residual water contents under ambient conditions or using a vacuum oven at approximately 233 K (60° C.). The water content of the PANI-EB powder was determined by thermogravimetric analysis (TGA). If the mass % of water in the PANI-EB powder was found to be lower than the chosen amount, additional deionized water was added to the powder prior to preparing the spin solution to achieve the chosen water content. The percentage water in the spinning solutions was between 0.1 and 0.6 mass %, which corresponds to a water content in the polyaniline of between 2 and 12 mass %.

As the solutions become more concentrated, the viscosity thereof increases. This results in additional heat being generated by viscous dissipation. In order to minimize heat build-up and ensure that the solution temperature remained below 308 K (35° C.), coolant was circulated around the outside of the mixing vessels.

(1) 6 mass %:

Polyaniline (PANI) (84.2 g) and 2-acrylamido-2-methyl-1-propanesulfonic acid (AMPSA) (115.8 g) were milled together using large zirconia grinding beads 30 min. before 1 g of water was added. Milling was continued for an additional 90 min. The gray PANI.AMPSA powder mixture was then separated from the grinding media by sieving.

Dichloroacetic acid (DCAA) (940 g) was poured into a 2 L stainless steel beaker placed in a water bath at 283 K (10° C.). A first 20 g portion of PANI.AMPSA$_{0.6}$ powder was added over 1 h to the DCAA with vigorous stirring. Second and third, 20 g portions of the PANI.AMPSA$_{0.6}$ powder mixture were added over the next 2 h. The mixing was continued overnight.

Approximately 1 kg of the resulting solution was placed under low vacuum (50 mbar) until the solution was completely degassed (about 30 min.). The degassed solution was observed to be lump-free and fluid, with a typical room-temperature viscosity of approximately 3000 cP. The solution was found to be stable for at least 2 d when stored under ambient conditions, before light gelling commenced.

The degassed solution was placed inside of a pressure vessel and 20 psi of nitrogen gas pressure was applied to the vessel to direct the solution to the gear pump. The solution was passed through a 230 μm pore filter prior to entering the gear pump. The Mahr & Feinpruf gear pump included 2 interlocking cogs which deliver 0.08 cm$^3$ of solution per revolution. The gear pump was adjusted to deliver 1.3 cm$^3$·min.$^{-1}$ of the spin solution. The solution was then passed through 230 and 140 μm pore filters before entering a 250 μm diameter spinneret (l/d=4). The spinneret was immersed in an ethyl acetate coagulation bath (wet spinning). The fiber was passed through the coagulation bath for about 1 m before being taken up on a pair of rotating 16.5 cm diameter godet drums (12.0 rpm; 6.2 m·min.$^{-1}$) immersed in a 1 M solution of phosphoric acid. Chemical analysis showed that the partially dopant exchanged fiber resulting from this process had the composition: PANI.AMPSA$_{0.20}$.DCAA$_{0.27}$ $(H_3PO_4)_{0.35}$. In chemical formulae of this type the fractional numbers correspond to the number of molecules of the indicated compound relative to the number of nitrogen atoms in the polymer backbone.

The fiber was then passed through a 1.2 m long heat tube maintained at a temperature of 363±10 K (90±10° C.) and wound onto a second godet pair having the same diameter and the first pair, and turning at 15.6 rpm (8.1 m·min.$^{-1}$), thereby stretching the fiber with a 1.3:1 stretch ratio. The fiber was then collected on a 15 cm diameter bobbin turning at 18 rpm (8.5 m·min.$^{-1}$) and allowed to dry at ambient conditions for several weeks. About one month later, a section of the fiber was measured and found to have a diameter of 56±2 μm, a conductivity of 270±30 S/cm, a peak stress of 108±9 MPa, a modulus of 4.1±0.3 GPa, and an extension at break of 20±4%.

Fibers were also spun into 2-butanone with similar results.

(2) 12 mass %:

Typically, 12 mass % solutions were prepared by first dissolving ½ of the AMPSA in the DCAA solvent. The remaining AMPSA was then ground with the PANI-EB powder forming a PANI/AMPSA powder mixture, and added to the DCAA solution in discrete portions with mixing over a 5–7 h period. Equally effective was dissolving all of the AMPSA in the DCAA, and adding the PANI-EB powder to the DCAA solution in discrete portions with mixing over a 5–7 h period, combining the PANI-EB and AMPSA powders using a ball mill and adding the mixture to the DCAA in discrete portions. The final solution properties have been found to be independent of the method for powder addition, so long as the rate of powder addition of each portion was chosen to maintain the solution temperature below 308 K (35° C.) in order to avoid gelation.

Using PANI-EB powder having 10 mass % water, a 12 mass % PANI.$AMPSA_{0.6}$ was prepared by dissolving 34.8 g of AMPSA in 437.2 g of DCAA, and adding 27.4 g of PANI-EB powder to the DCAA solution in discrete portions with mixing over a 5 h period. The total mixing time was 12.5 h. To remove entrapped air caused by the mixing process, the solutions were degassed under vacuum at 50 mbar for 1 h before they were spun into fibers.

The fiber spin line included a gear pump and 3, post-pump, in-line filters (230, 140 and 60 μm pore size). The diameter of the spinneret used was 150 μm with a length to diameter ratio (l/d) of 4. The fiber spinning solution was wet spun at ambient temperature (between 289 and 298 K (16 and 25° C.)) into an ethyl acetate (EA) coagulation bath at a flow rate of 0.4 $cc \cdot min^{-1}$. The fiber was then wound around a first pair of 0.165 m diameter godets rotated in air at ambient conditions. The fiber was subsequently passed through a 1.2 m long heat tube maintained at a temperature between 323 and 373 K (50 and 100° C.), and wound around a second pair of godets turning 2.0 times faster than the first godet pair. The second godet drums were not immersed in a solvent. The fiber was next wound onto a 15 cm diameter bobbin using a Leesona fiber winder, and stored for at least 1 d under ambient conditions before undergoing dopant exchange.

From the large bobbin of fiber, approximately 3 g of fiber was wound onto smaller ceramic bobbins. The as-spun polyaniline fiber was first dedoped to its EB oxidation state by immersing the fiber in 2 L of a 0.1 M aqueous solution of $NH_4OH$ for 30 min. After the fiber was dried for 24 h under ambient conditions, the fiber was divided into 3 approximately equal lengths. To complete the dopant exchange process, the fibers were then redoped by immersing the EB fiber in aqueous solutions of different acids, each having pH 2, for 24 h. The first length of the EB fiber was redoped with phosphoric acid (PANI.$(H_3PO_4)_{0.7}$; 65 μm diameter), the second length of fiber was redoped with triflic acid (PANI.$(CF_3SO_3H)_{0.55}$; 68 μm diameter) and the third length of fiber was redoped with HCI (PANI.$HCI_{0.48}$; 62 μm diameter). Note that a dopant fraction of 0.5 indicates a fully doped polymer fiber when the anion is incorporated into the polymer molecules (that is, one dopant molecule for every 2 nitrogen atoms in the polymer backbone). The fibers were then exposed to ambient conditions for at least 24 h to remove residual water.

The mechanical and electrical properties of the fiber were measured after being exposed to ambient conditions for 1 week. The fiber diameter was found to be 68±2 μm, the fiber conductivity equal to 475±40 S/cm, its peak stress equal to 110±3 MPa, the fiber modulus equal to 2.9±0.2 GPa, and the fiber extension at break equal to 11±3%.

C. Measurements:

Reference will now be made in detail to the present preferred embodiments of the invention examples of which are illustrated in the accompanying drawings. FIGS. 1–15 represent data derived from 6 mass % solutions of polyaniline spun into ethyl acetate coagulant and partially dopant exchanged using phosphoric acid. Conductivity as a function of temperature, conductivity and temperatures as a function of applied constant current, and conductivity and temperature as a function of applied constant voltage were studied for doped polyaniline fiber using chromel-constantan differential thermocouples (chromel contains 90% Ni and 10% Chromium; and constantan contains 45% nickel and 55% copper), based on the procedures for 4-probe (4-point) resistance measurements in ASTM Designation D4496-87 (1998 standard) "Standard Test Method for D-C Resistance or Conductance of Moderately Conductive Materials."

FIG. 1 is a graph of the temperature dependence of the conductivity of PANI.$AMPSA_{0.20}$.$DCAA_{0.27}$.$(H_3PO_4)_{0.35}$ fibers. Fibers having this composition were used for the measurements described in FIGS. 1–15 hereof. Measurements for FIG. 1 were made with the fiber placed in a temperature-controlled environment under vacuum with only the measurement current passing through the fibers. Conductivity of doped polyaniline fiber is seen to rise from 17 S/cm at 6 K (−267° C.) to 462 S/cm at 293 K (20° C.). At temperatures above 304 K (31° C.), the conductivity decreases.

Thermal characteristics of doped polyaniline fibers were also investigated both under ambient conditions and under vacuum by applying a constant current to 8.5 mm long fibers having a diameter of 95 μm.

Figure 2:
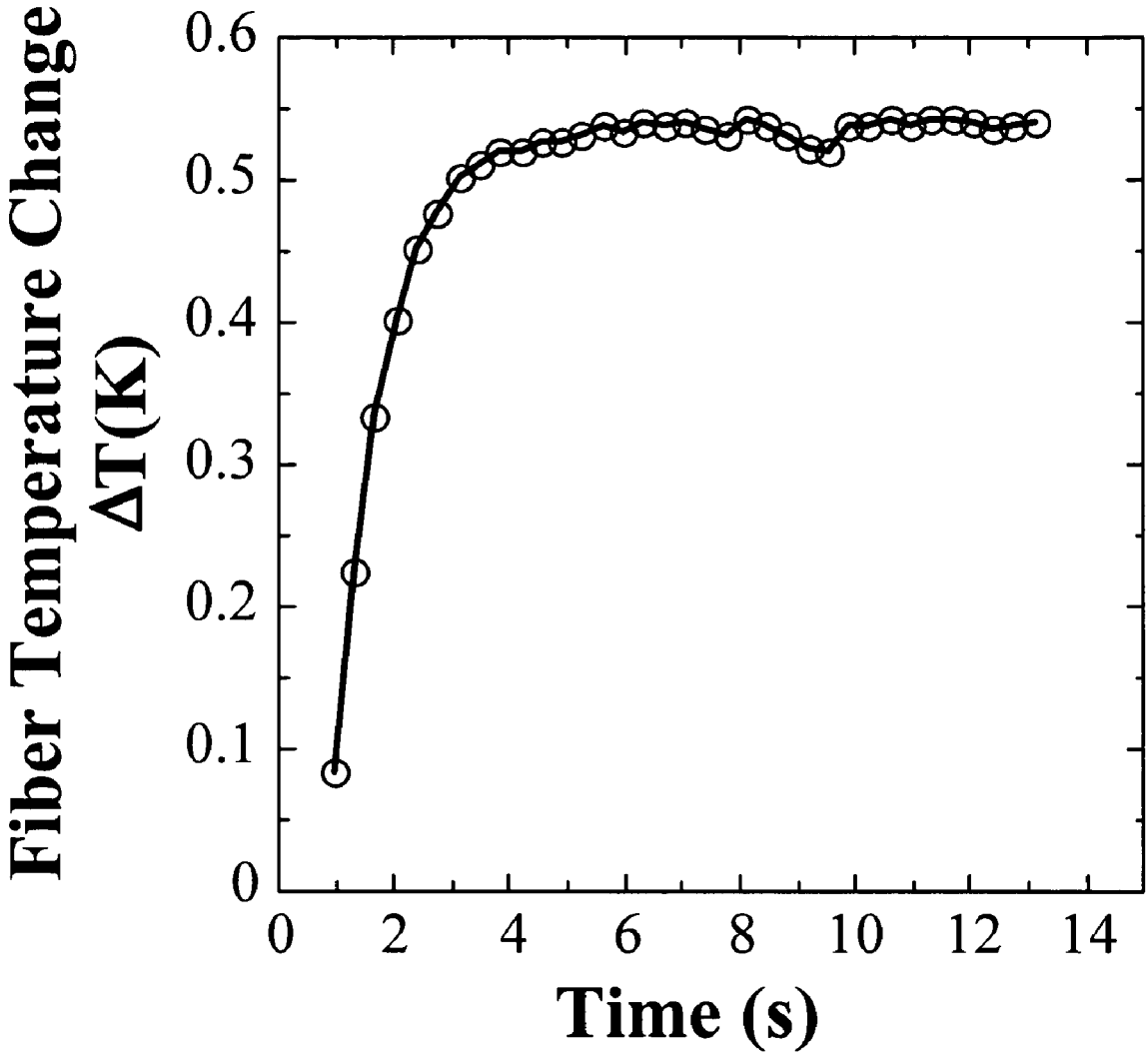
FIG. 2 is a graph of temperature change as a function of time for the conductive polyaniline fiber with a constant current of 5.0 mA passing therethrough at ambient conditions, where the baseline temperature is 296.1 K (22.9° C.).
Figure 3:
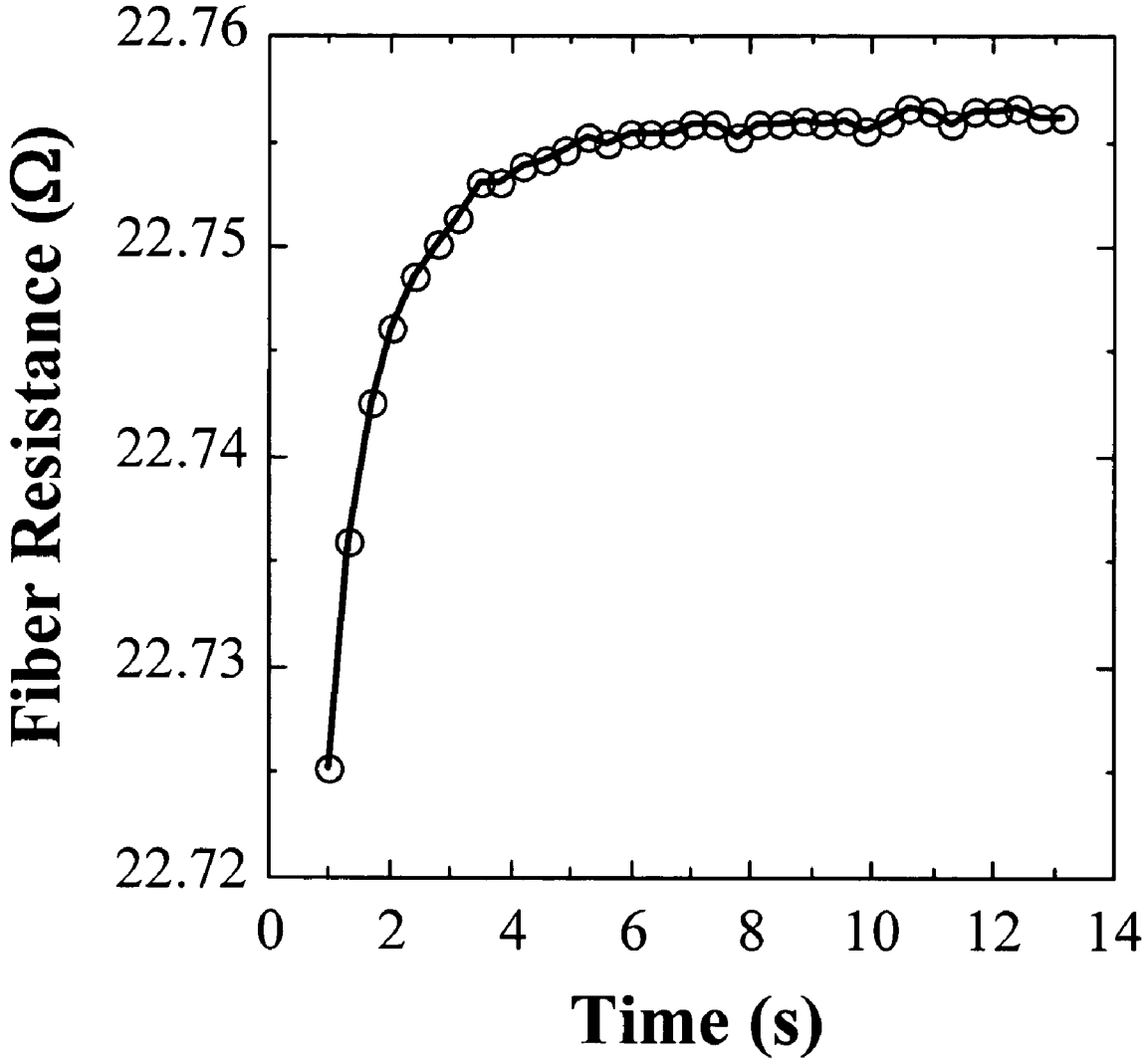
FIG. 3 is a graph of fiber resistance as a function of time for the conductive polyaniline fiber with a constant current of 5.0 mA passing therethrough at ambient conditions, where the baseline temperature is 296.1 K (22.9° C.).
Figure 4:
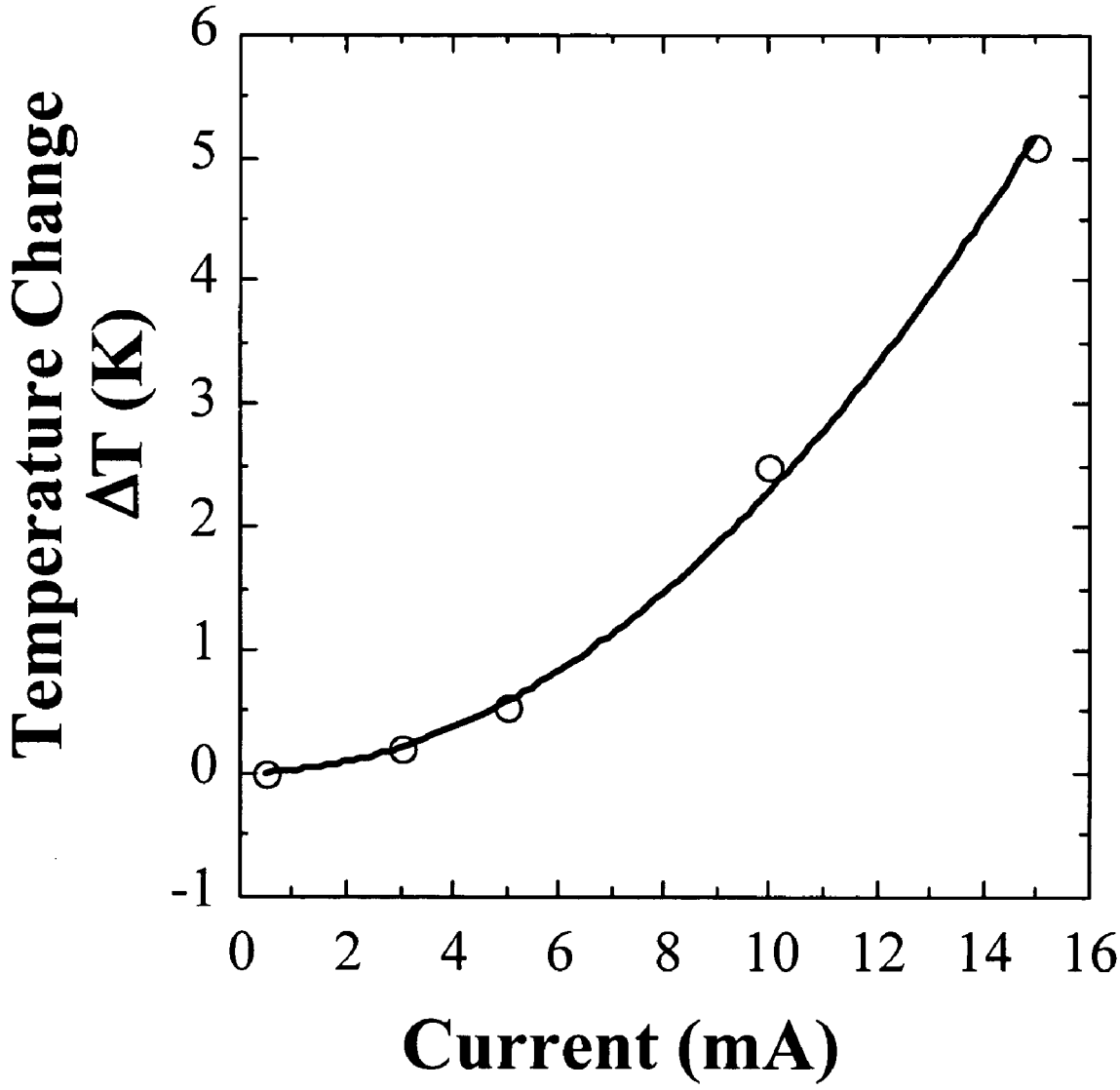
FIG. 4 is a graph of the temperature change as a function of constant current passing through the conductive polyaniline fiber under ambient conditions, where the baseline temperature is 296.1 K (22.9° C.).

When a constant current is applied to the fibers, typical graphs of fiber temperature change as a function of time and fiber resistance as a function of time under ambient conditions are shown in FIGS. 2 and 3, respectively. As can be seen from FIGS. 2 and 3, when the heat generated inside the fiber equals the heat transferred from the fiber to the surrounding environment (heat lost by the fiber), the fiber temperature change and fiber resistance will remain constant. FIG. 4 is a graph of the stable temperature change as a function of the current passed through the fiber under ambient conditions. By stable temperature change, it is meant the measured temperature change once the temperature has stabilized at a constant value. In all experiments, the base temperature was 22.9° C.

FIG. 4 also shows a polynomial curve fitted to the experimental data. The fitting equation is:

$$y=m_1I^2, \qquad \text{Equ. 1}$$

where I is the current, y is the fitted temperature change, and $m_1$ is a real coefficient (0.0230±0.0004). Since $\chi^2$ for this fit is small (0.0468) and R (Pearson's "R" coefficient) is close to 1 (0.999), Equ. 1 is a good fit to the experimental data. Thus, under ambient conditions, the stable temperature change of the conductive polymer fibers subjected to a constant current stimulus is proportional to the square of the current passing through the fibers.

Figure 5:
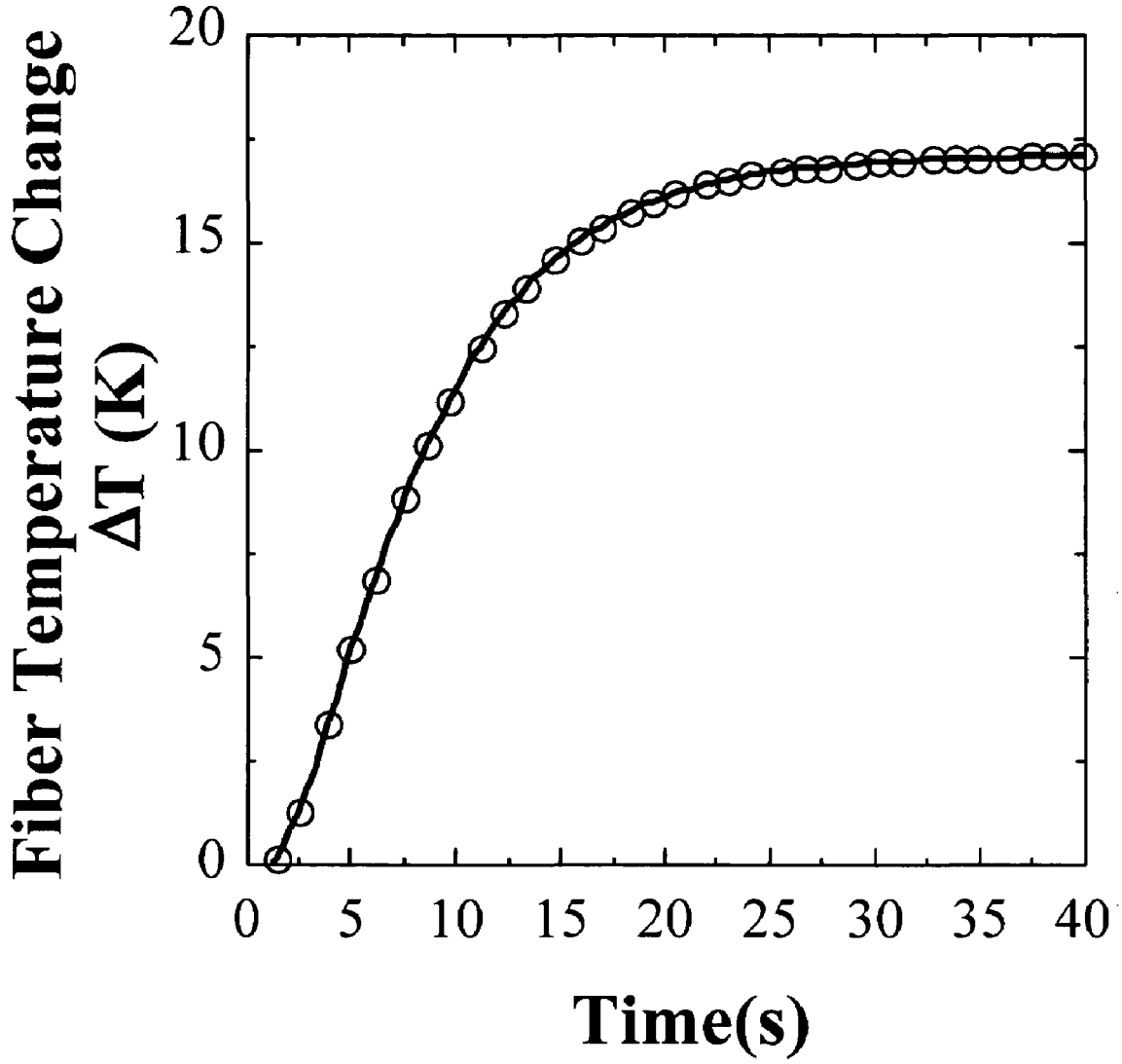
FIG. 5 is a graph of the temperature change as a function of time for the conductive polyaniline fiber with a constant current of 9.0 mA passing therethrough under vacuum, where the baseline temperature is 296.1 K (22.9° C.).
Figure 6:
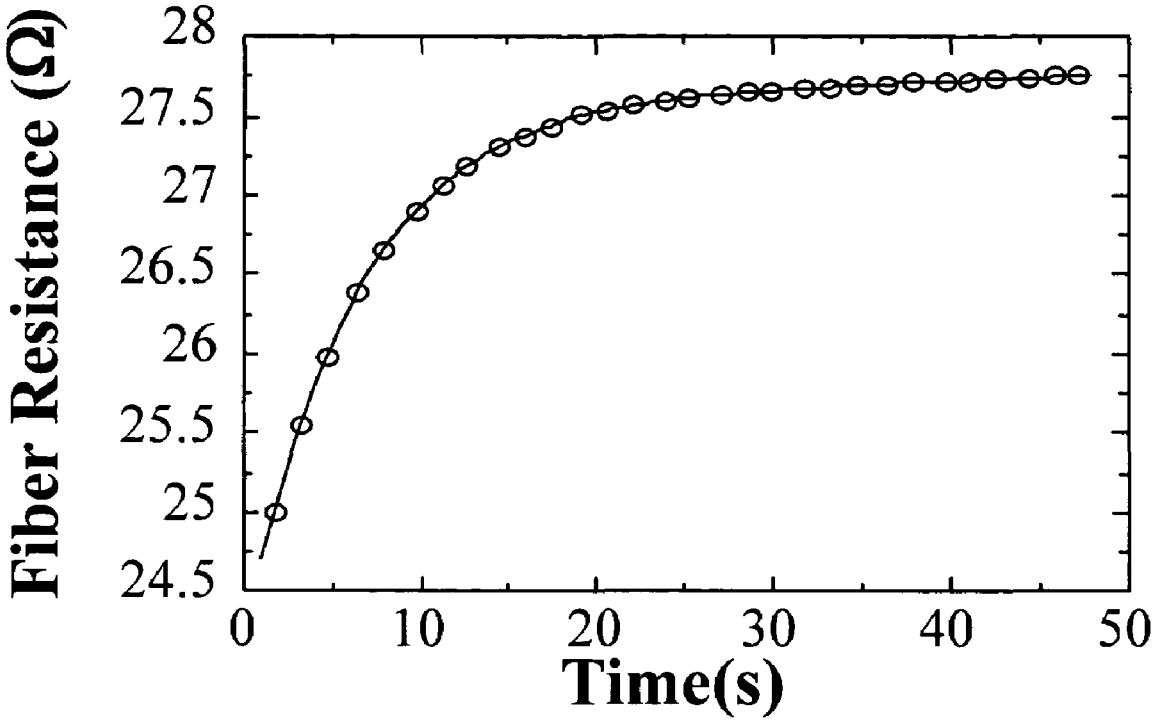
FIG. 6 is a graph of the resistance as a function of time for the conductive polyaniline fiber with a constant current of 9.0 mA passing therethrough under vacuum.

Typical graphs of fiber temperature change as a function of time under vacuum and fiber resistance as a function of time under vacuum when a constant current is applied are shown in FIG. 5 and FIG. 6, respectively. A graph of the stable temperature change as a function of current passing therethrough is shown in FIG. 7.

Figure 7:
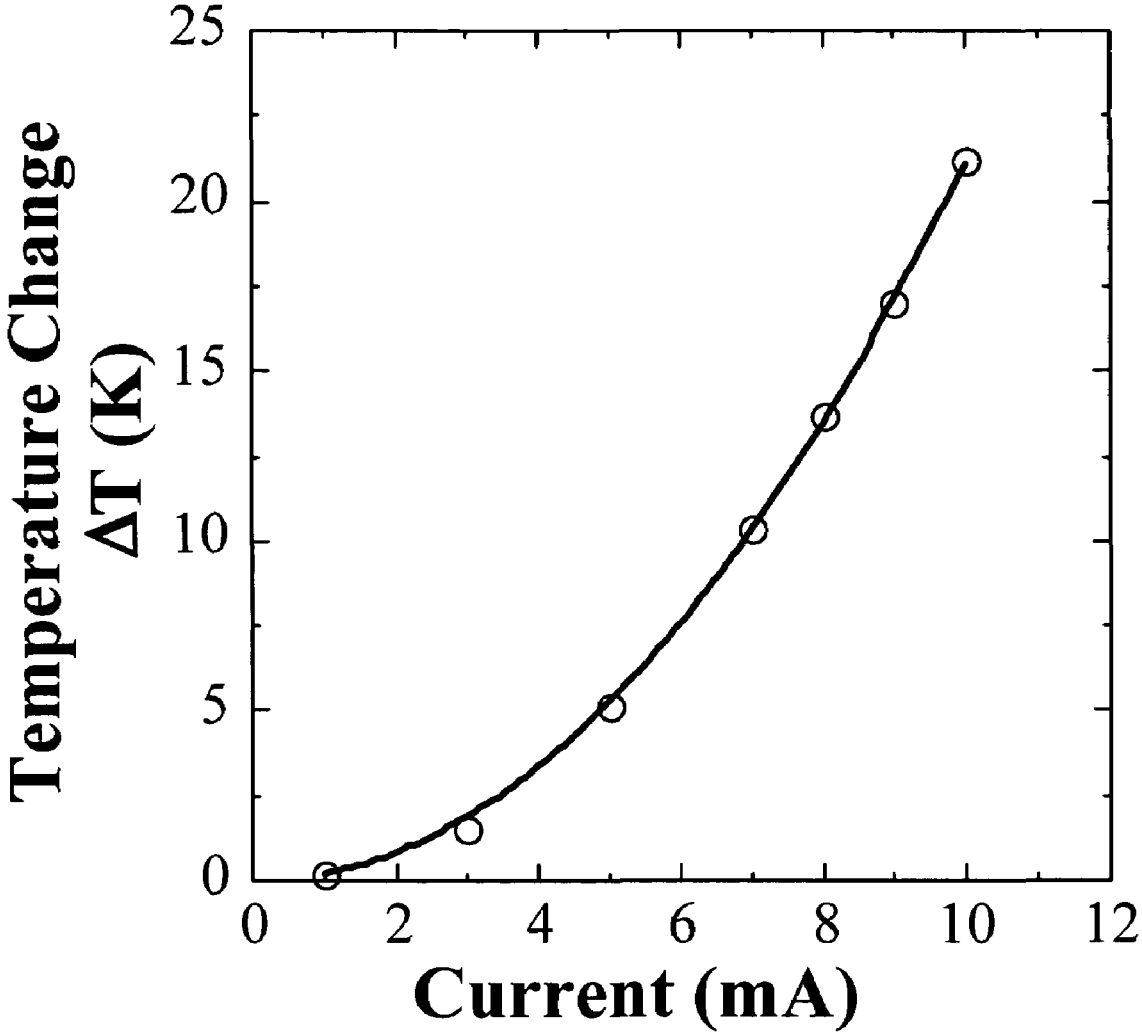
FIG. 7 is a graph of the change in temperature of the conductive polyaniline fiber as a function of current under vacuum, where the baseline temperature is 296.1 K (22.9° C.).
Figure 8:
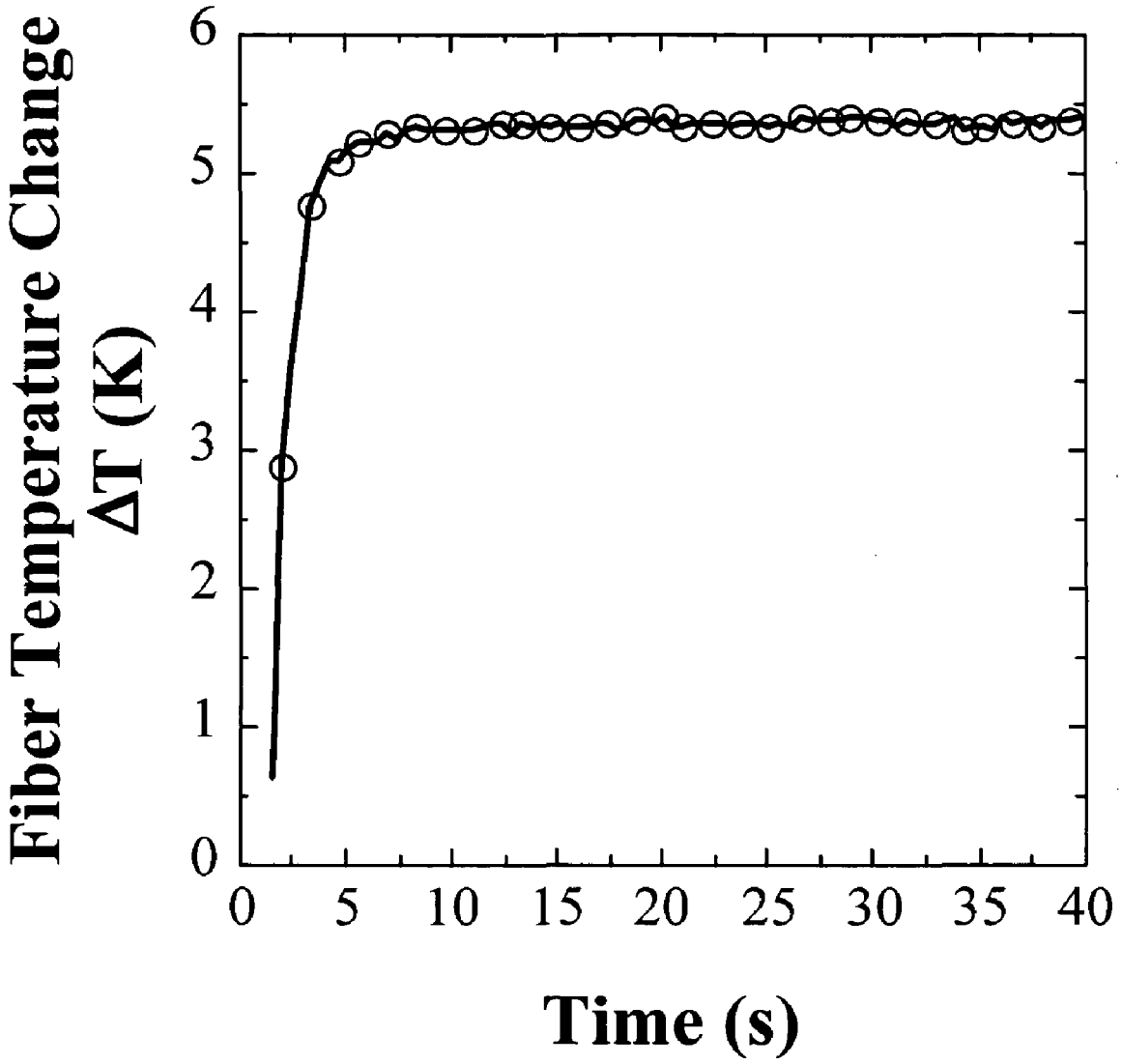
FIG. 8 is a graph of the change in temperature as a function of time for the conductive polyaniline fiber to which a constant voltage of 2.0 V is applied under ambient conditions, where the baseline temperature is 296.1 K (22.9° C.).
Figure 9:
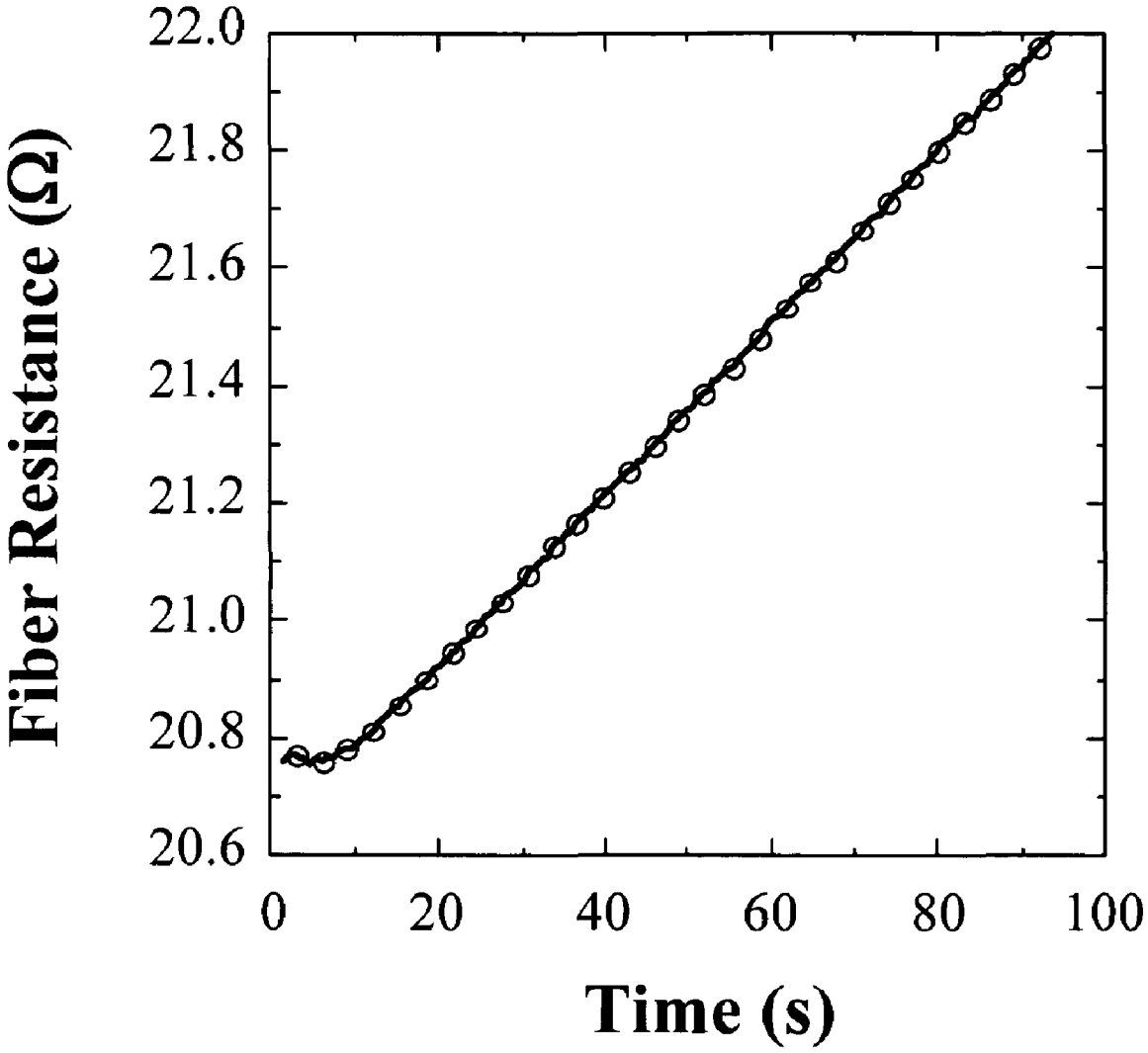
FIG. 9 is a graph of fiber resistance as a function of time for the conductive polyaniline fiber to which a constant voltage of 2.0 V is applied under ambient conditions.
Figure 10:
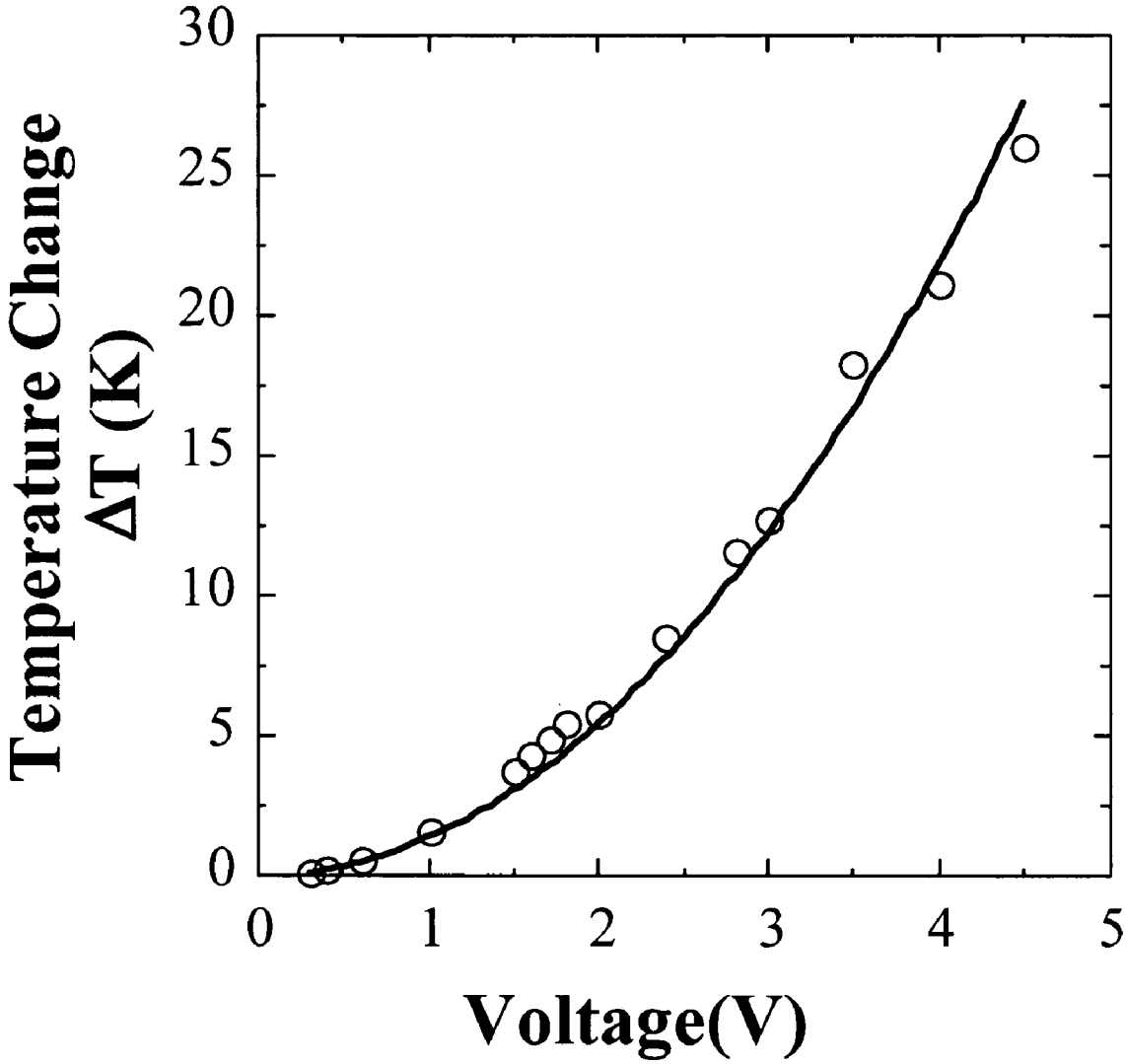
FIG. 10 is a graph of temperature change as a function of applied voltage for the conductive polyaniline fiber under ambient conditions, where the baseline temperature is 296.1 K (22.9° C.).

In FIG. 7, the stable temperature change is proportional to the square of the current in the fibers. The coefficient $m_1$ set forth in the insert of FIG. 7 is 9.1 times that set forth in FIG. 4 hereof. This means that with the same constant current stimulus, the stable temperature change under vacuum is 9.1 times higher than that under ambient conditions. When a constant voltage is applied, the change in fiber temperature as a function of time, and the fiber conductivity as a function of time are shown in FIG. 8 and FIG. 9 hereof, respectively. FIG. 10 shows that the stable temperature change as a function of applied voltage under ambient conditions is proportional to the square of the voltage on the fibers (R=0.994 and $\chi^2$=10.35) which is similar to the variation of the stable temperature as a function of current shown in FIG. 4 hereof.

Figure 11:
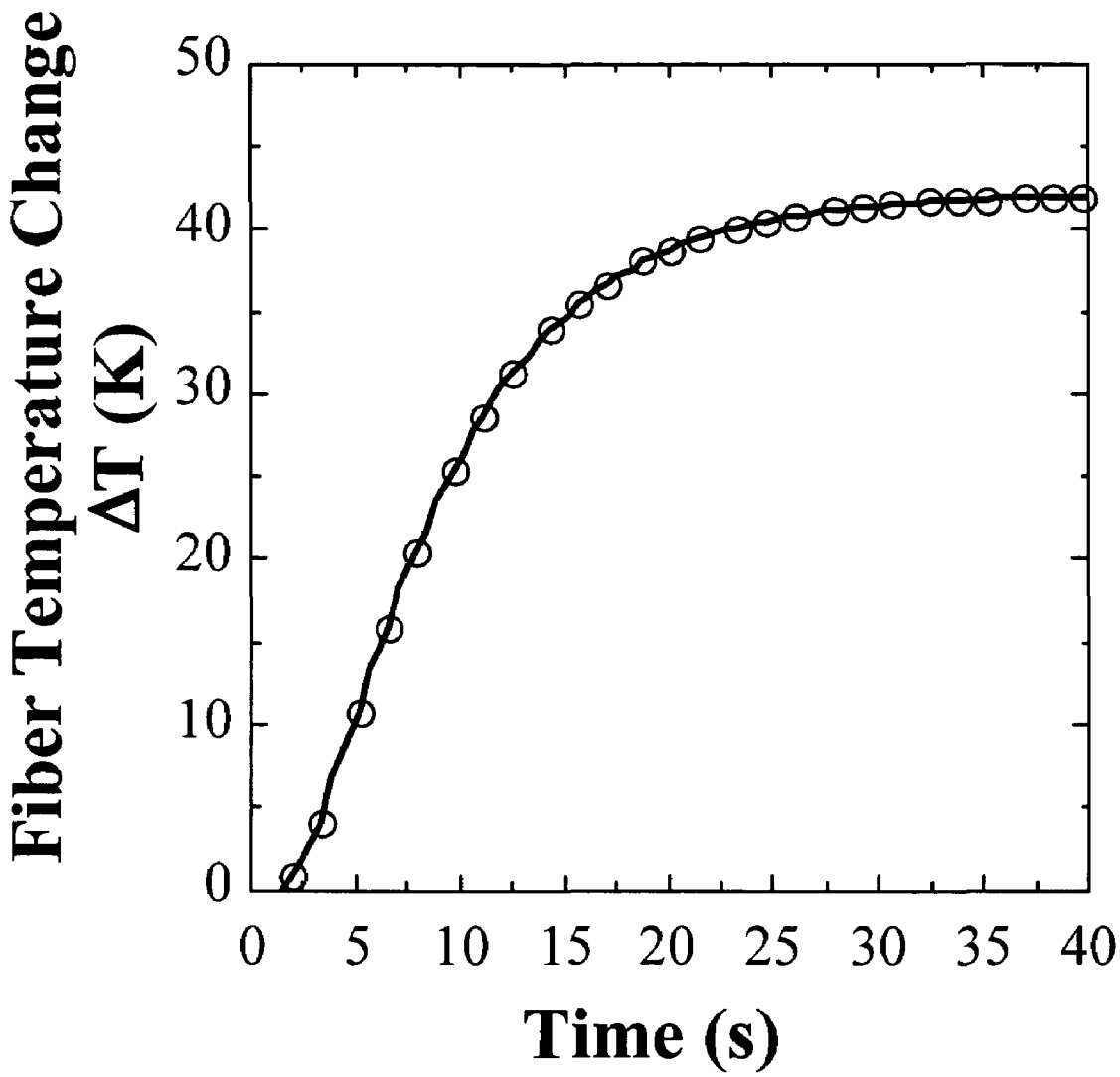
FIG. 11 is a graph of temperature change as a function of time for the conductive polyaniline fiber to which a constant voltage of 1.5 V is applied under vacuum, where the baseline temperature is 296.1 K (22.9° C.).
Figure 12:
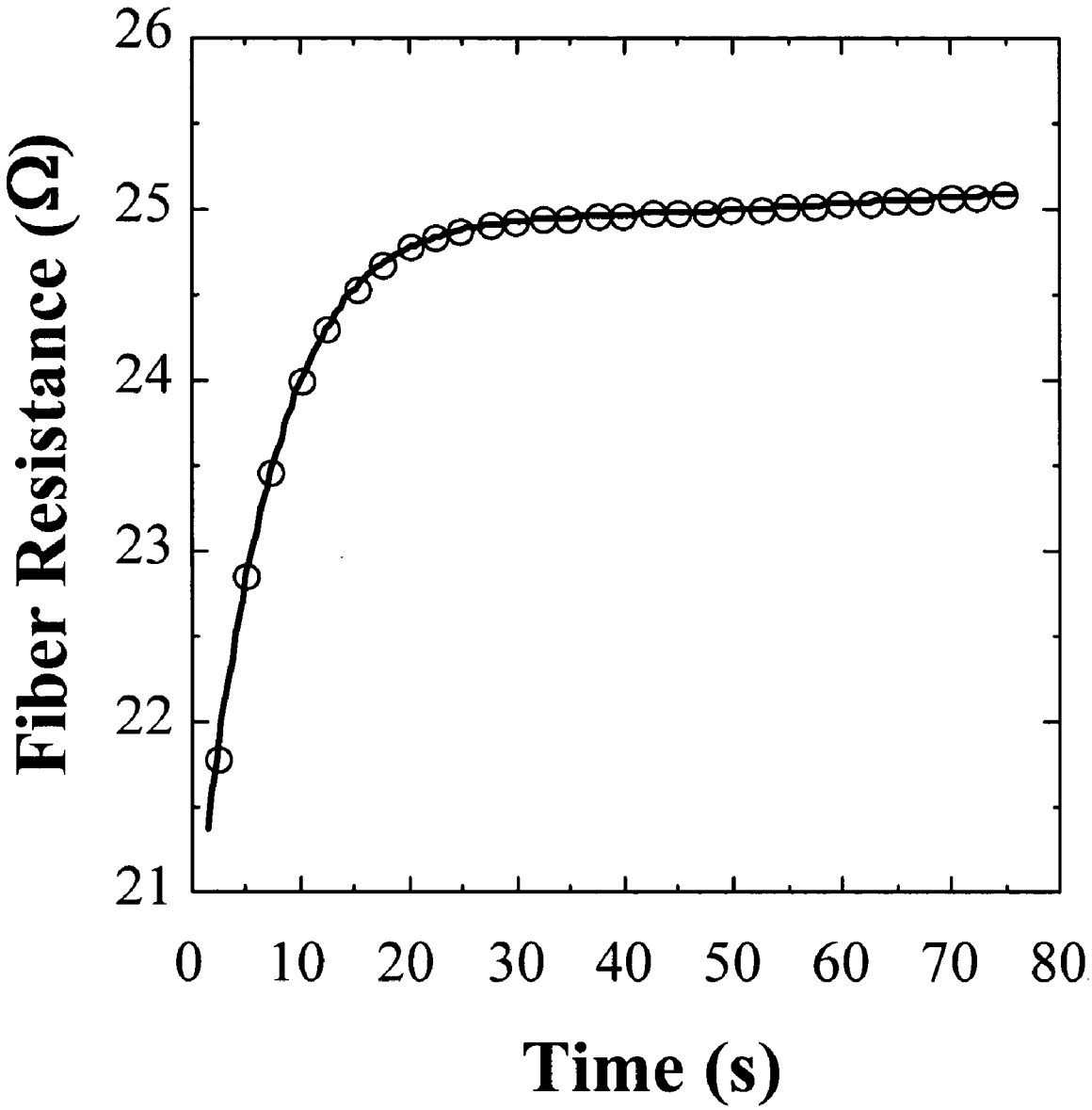
FIG. 12 is a graph of fiber resistance as a function of time for the conductive polyaniline fiber to which a constant voltage of 1.5 V is applied under vacuum.
Figure 13:
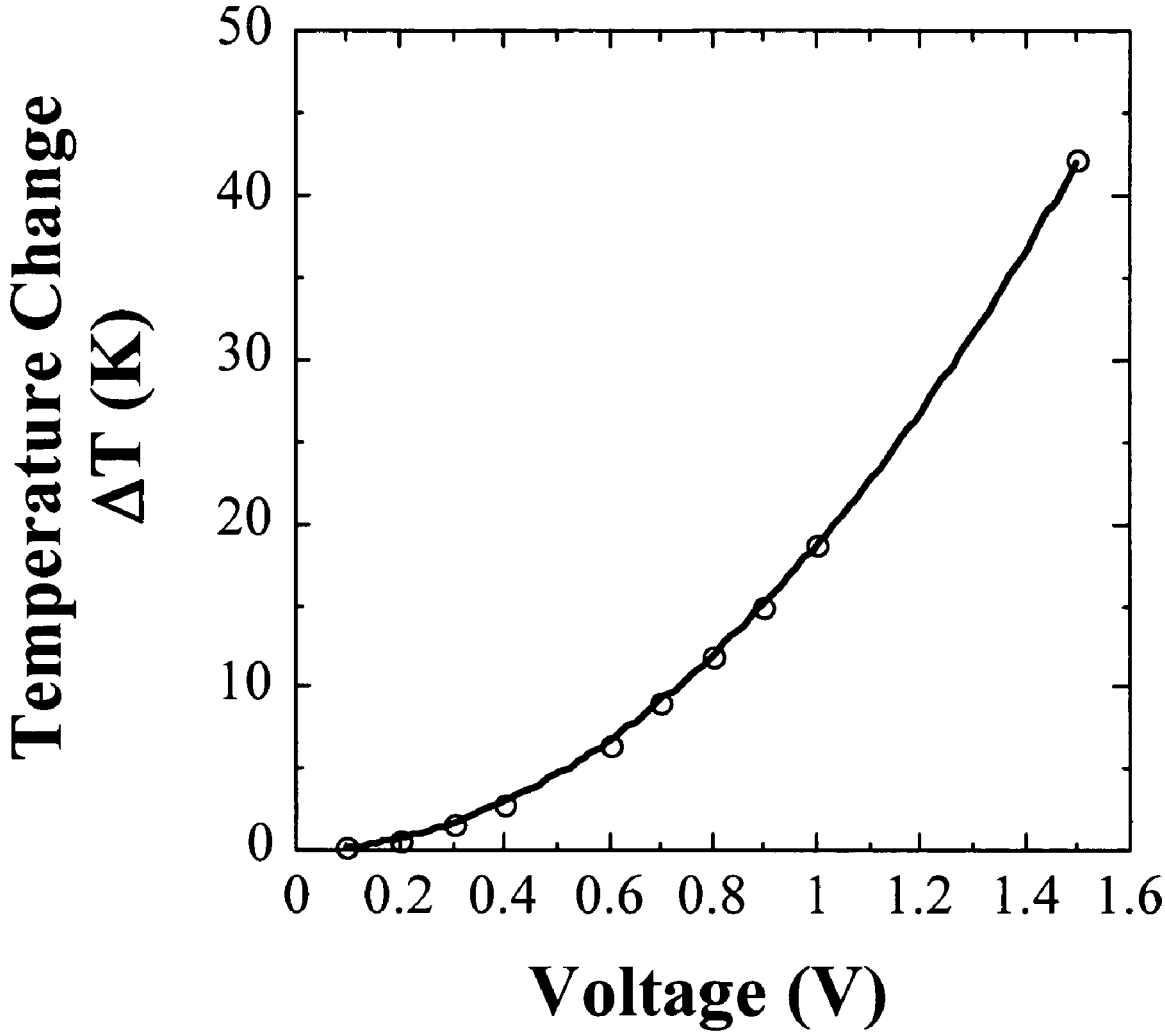
FIG. 13 is a graph of temperature change as a function of applied voltage for the conductive polyaniline fiber under vacuum, where the baseline temperature is 296.1 K (22.9° C.).

When a constant voltage is applied to the fibers, typical graphs of fiber temperature change as a function of time, and fiber conductivity as a function of time for fibers under vacuum are shown in FIG. 11 and FIG. 12 hereof respectively. FIG. 13 is a graph of the stable temperature change as a function of applied voltage, again for fibers under vacuum. It is seen in FIG. 13 that the stable temperature change is proportional to the square of the voltage applied to the fibers. The coefficient $m_1$ for the curve in FIG. 13 is 13.7 times of that in FIG. 10 hereof; that is, for the same applied voltage, the stable temperature change under vacuum is 13.7 times higher than that under ambient conditions.

Using a temperature sensor which has a much larger surface area than that of the chromel-constantan thermocouple, and therefore measures average temperature under conditions of significant heat transfer, the temperature change of a doped polyaniline twisted yarn comprising twenty, 59 μm diameter monofilaments that were twisted until a twist ratio of 14 TPI was obtained, was measured under ambient conditions as a function of applied voltage. The length of the yarn sample was 3.75 in. and the average diameter of the yarn sample was 315 μm. In a similar manner to the single fiber situation, the average temperature change as a function of applied voltage exhibited a quadratic dependence with $m_1$=0.183±0.011, $\chi^2$=2.24 and R=0.966 (Equ. 1). Such a temperature measurement is expected to more closely describe the situation where the heating fibers are incorporated into a heating element.

Figure 14:
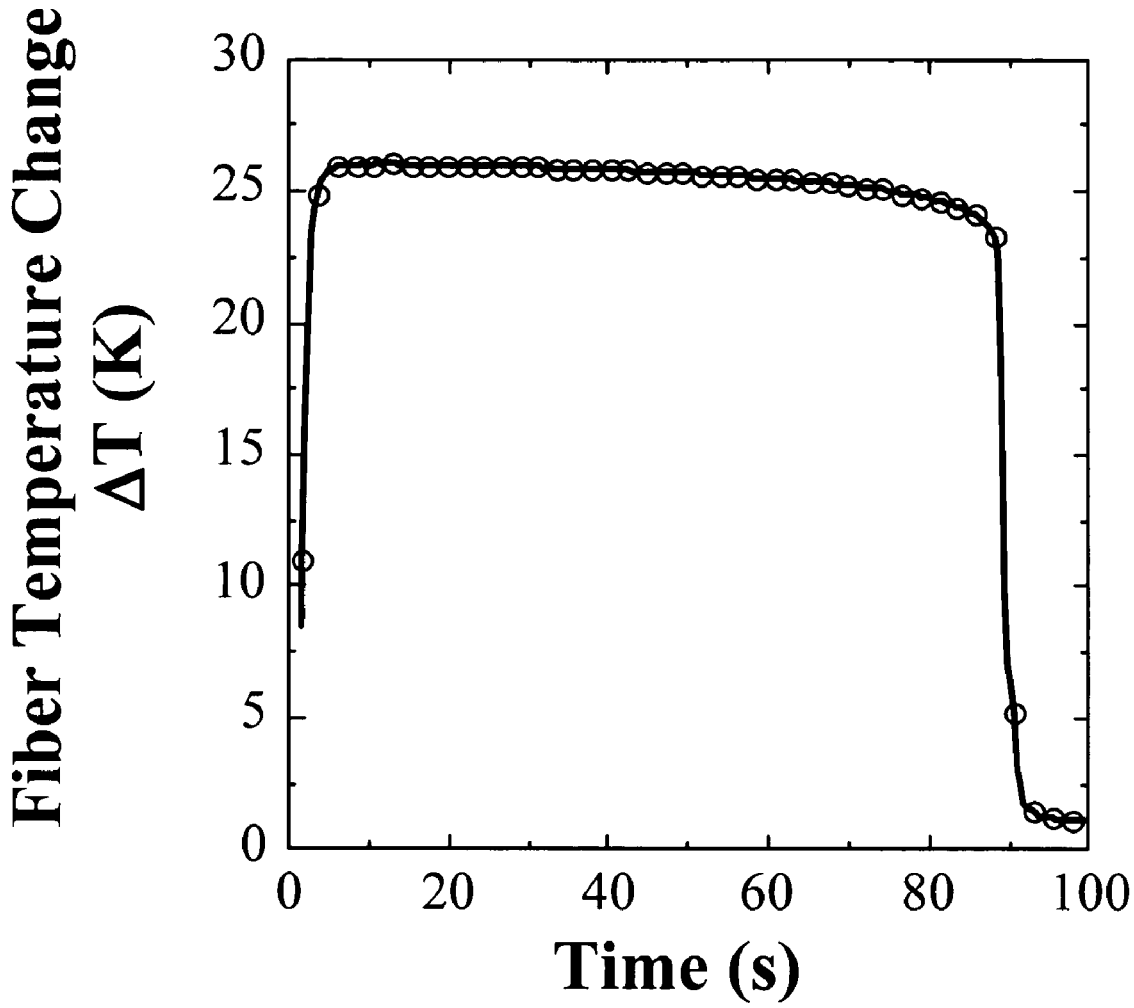
FIG. 14 is a graph of fiber temperature change as a function of time for the doped polyaniline fiber when a constant overload voltage of 4.5 V is applied thereto at ambient conditions, where the baseline temperature is 296.1 K (22.9° C.).
Figure 15:
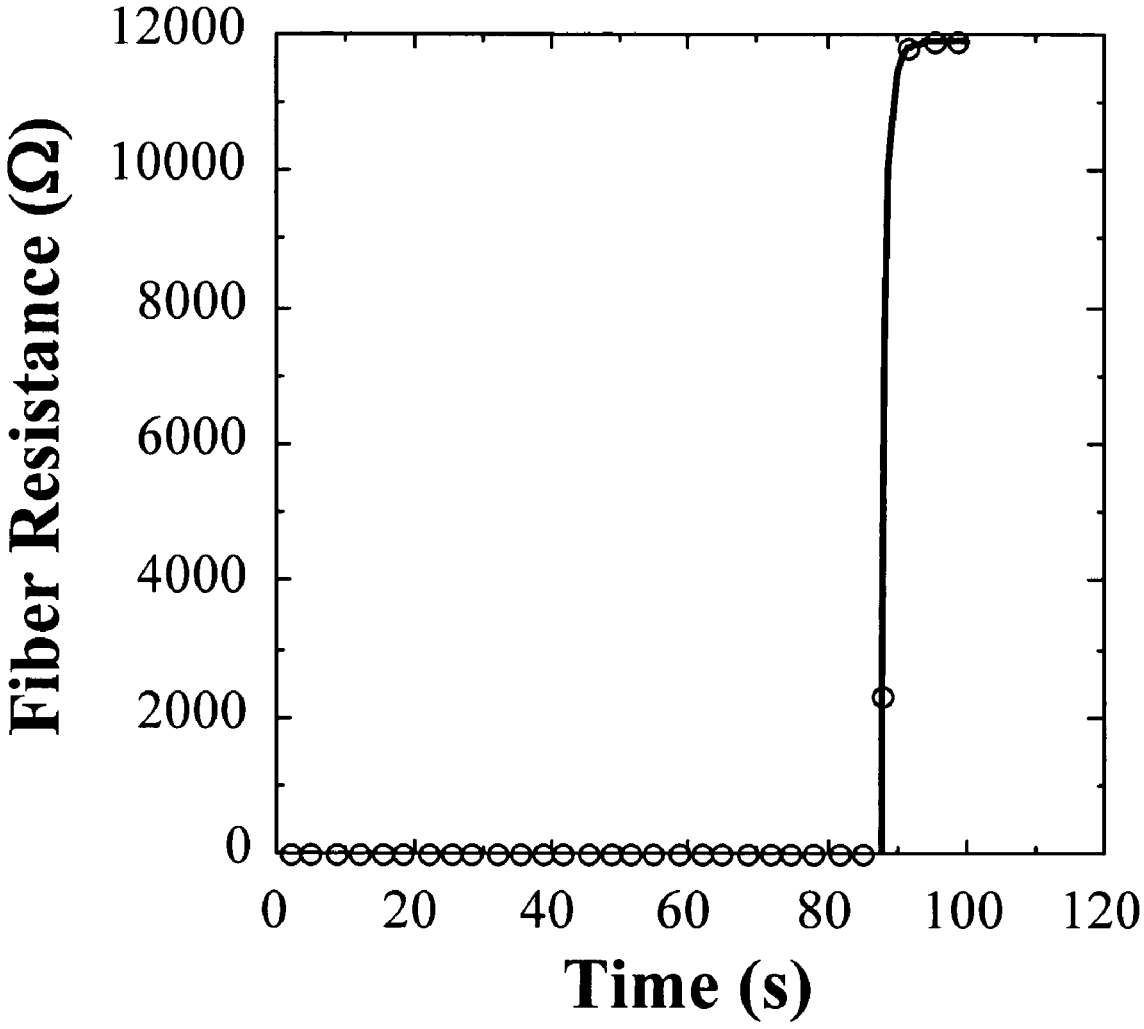
FIG. 15 is a graph of fiber resistance as a function of time for the conductive polyaniline fiber when a constant overload voltage of 4.5 V is applied thereto under ambient conditions.

An overloading current or voltage characteristic of a particular conductive polyaniline fiber has been found to irreversibly destroy the conductivity of the polymer fibers. Graphs of the fiber temperature change as a function of time and the fiber conductivity as a function of time are shown in FIG. 14 and FIG. 15, respectively, for the situation where an overloading voltage of 1.0 V was passed through a doped polyaniline fiber. The fiber had a length of 12.0 mm and a diameter of 95 μm. As seen from FIG. 14 hereof, the temperature at destruction is approximately 321 K (48° C.) (base temperature of 296 K (23° C.)+temperature change of 298 K (25° C.)). To be noted is that the thermal decomposition temperature for AMPSA-doped polyaniline fibers is about 453 K (180° C.). According to the conductivity data shown in FIG. 1 hereof, fiber conductivity at 321 K (48° C.) should be approximately 450 S/cm (resistance of 37.6Ω). Since the conductive fiber is thin and the temperature change became stable when the fiber began losing its conductivity, the temperature difference between the inside of the fiber and the surface, and the temperature differences among different locations on the fiber were slight. Therefore, voltage or current overloading is a different phenomenon than found in most conductive wires which can only be destroyed by melting. It is believed by the present inventors that conductive polymer fibers are destroyed by the alteration of their conjugated structures which occurs at temperatures below the temperature at which dopants within the fiber are lost from the conductive fiber, or decompose. These processes also affect the polymer fiber conductivity and occur at temperatures between approximately 393 K (120° C.) and 523 K (250° C.), depending on the dopant (for example, 393 (120° C.) for HCI-doped polyaniline fibers, and 523 K (250° C.) for $H_3PO_4$-doped polyaniline fibers). It should be mentioned that the backbone of polyaniline fibers commences decomposition at greater than 593 K (320° C.).

Figure 16:
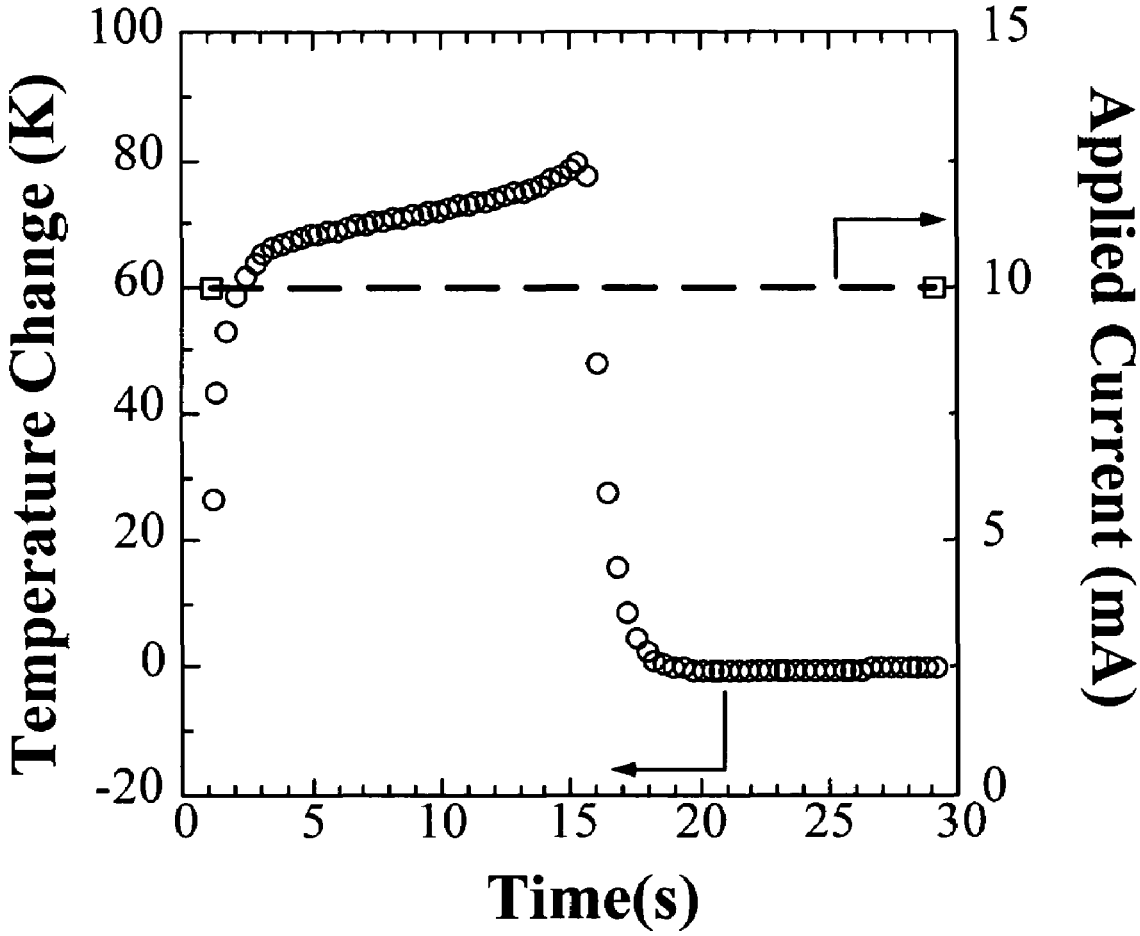
FIG. 16 is a graph of the temperature change of a polyaniline fiber redoped with $H_3PO_4$ as a function of time when a constant current of 10 mA is applied thereto, the fiber losing its electrical conductivity at about 375 K (102° C.).
Figure 17:
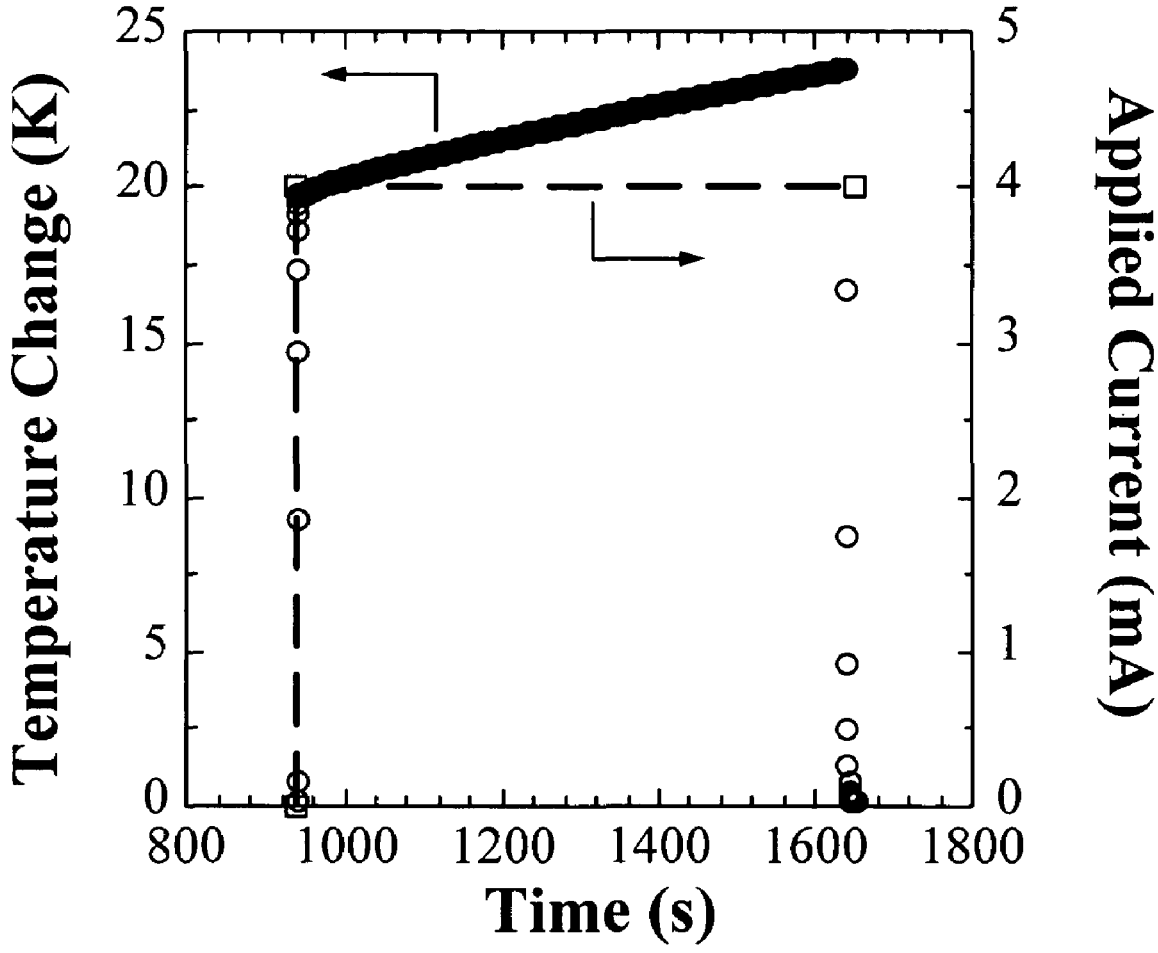
FIG. 17 is a graph of the temperature change of a polyaniline fiber redoped with HCI as a function of time when a constant current of 4 mA is applied thereto, the fiber losing its electrical conductivity at about 319 K (46° C.).
Figure 18:
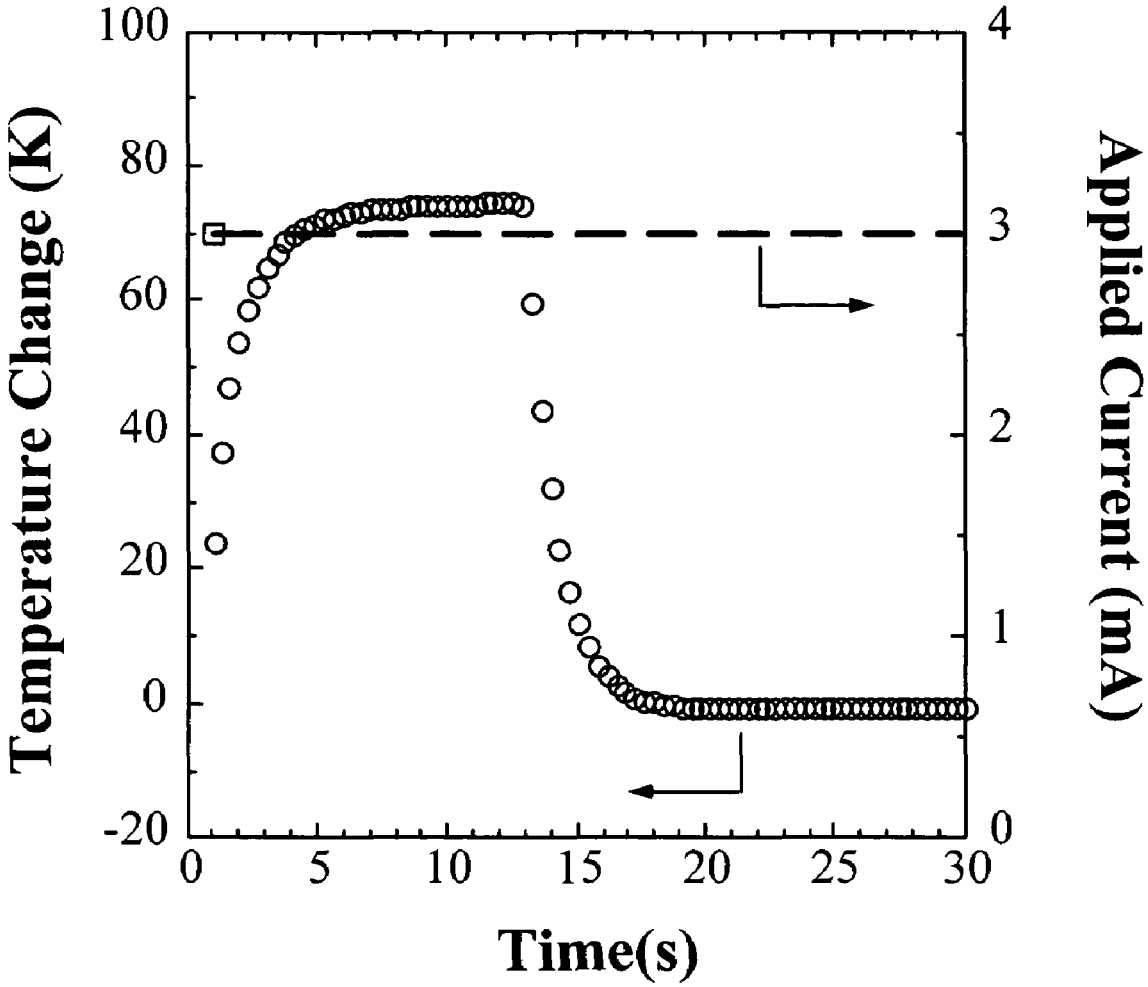
FIG. 18 is a graph of the temperature change of a polyaniline fiber redoped with $CF_3SO_3H$ as a function of time when a constant current of 3 mA is applied thereto, the fiber losing its electrical conductivity at about 370 K (97° C.).
Figure 19:
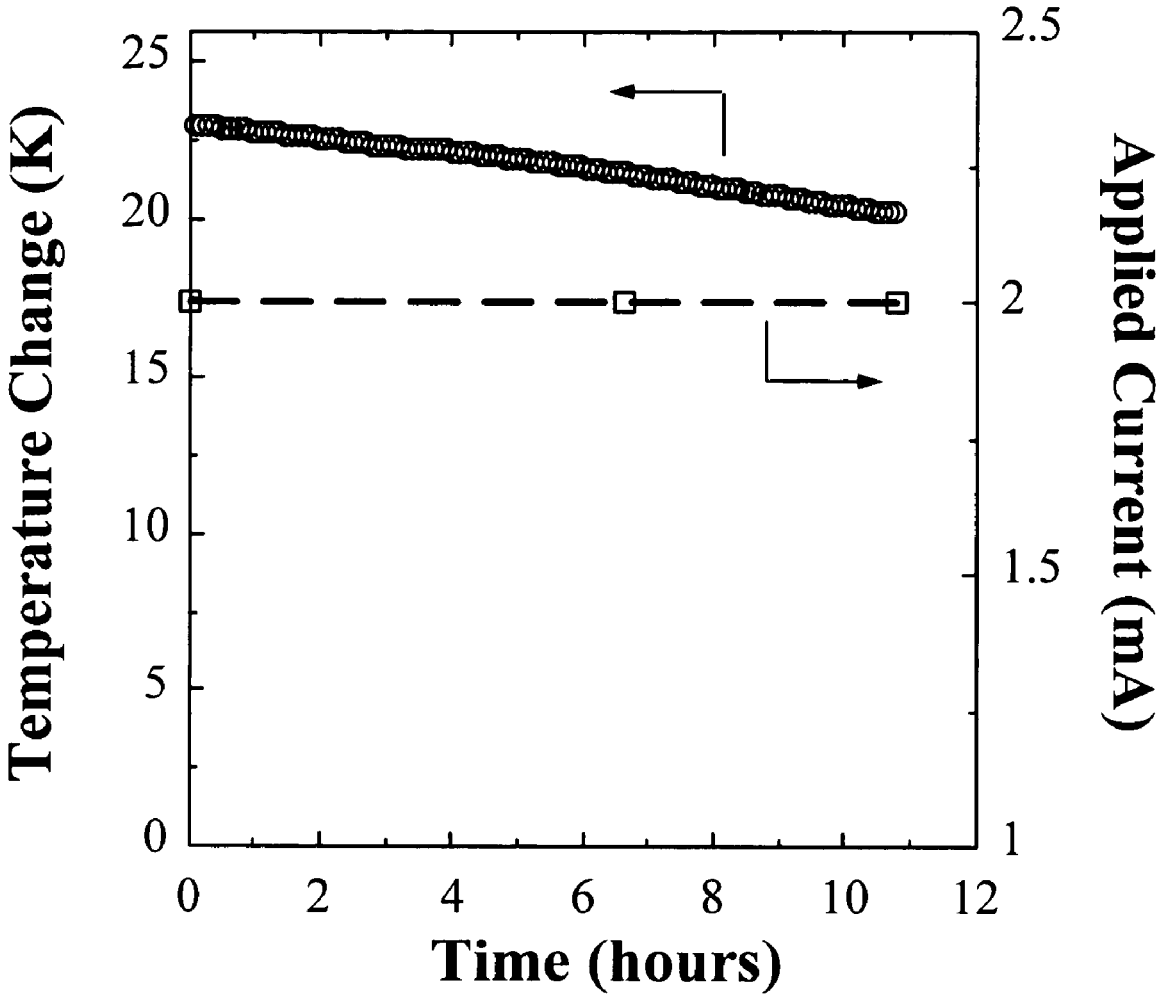
FIG. 19 is a graph of the temperature change of a polyaniline fiber redoped with $CF_3SO_3H$ as a function of time when a constant current of 2 mA is applied thereto.

For a given volume, conductive polymers have significantly fewer charge carriers than most metal conductors (such as copper, gold, silver, and aluminum) because of the large molecular weight of the polymer repeat unit, the low density of polymeric materials, and the mechanism for polymer conductivity. As a result, in conductive polymers, the charge mobility is much lower than that in metal conductors. Due to the heterogeneous structure described in Q. Li et al., Phys. Rev. B47, pp. 1840–1845 (1993); A. B. Kaiser et al., Synth. Met. 117, pp. 67–73 (2001); and A. B. Kaiser et al. Synth. Met. 69, pp. 197–200 (1995), and crystallites built during the spinning process, conductivity along the fiber is not uniform and electric currents can build up higher voltages at some places in the fiber. It is believed by the present inventors that such higher voltages may cause the local drift velocity of the charges in the fiber to become sufficiently high such that the conductive structure is destroyed and fiber conductivity is irreversibly lost. As depicted in FIGS. 16–19 hereof, the conductivity destruction temperature varies with fiber dopants. These fibers were generated using 12 mass % spinning solutions, which were dedoped and redoped as described hereinabove. FIG. 16 is a graph of the temperature change of a polyaniline fiber redoped with $H_3PO_4$ as a function of time when a constant current of 10 mA is applied thereto, FIG. 17 is a graph of the temperature change of a polyaniline fiber redoped with HCI as a function of time when a constant current of 4 mA is applied thereto, FIG. 18 is a graph of the temperature change of a polyaniline fiber redoped with $CF_3SO_3H$ as a function of time when a constant current of 3 mA is applied thereto, and FIG. 19 is a graph of the temperature change of a polyaniline fiber redoped with $CF_3SO_3H$ as a function of time when a constant current of 2 mA is applied thereto.

It is seen that a higher conductivity destruction temperature of 375 K (102° C.) is obtained for fibers doped with $H_3PO_4$, than the 319 K (46° C.) where HCI-doped fibers lose their conductivity.

Figure 20:
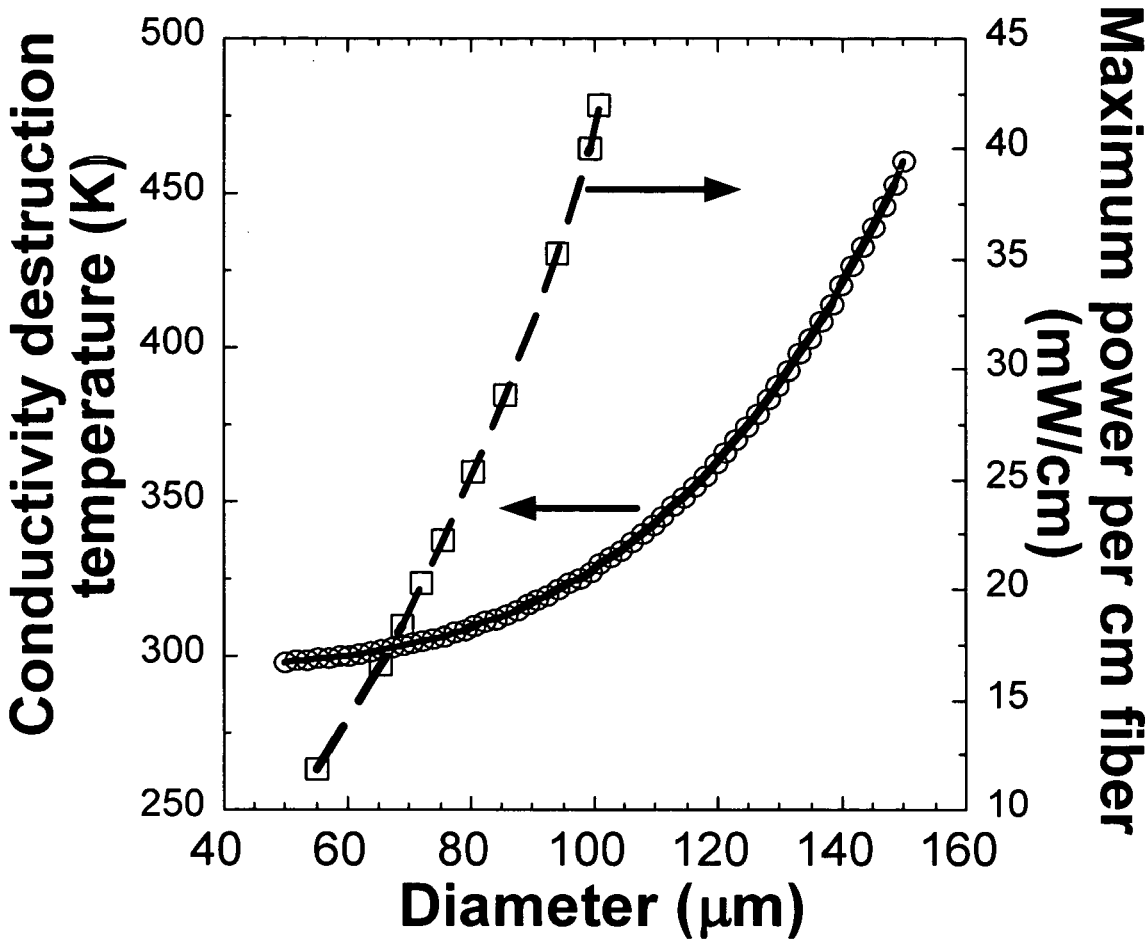
FIG. 20 is a graph of both the calculated fiber conductivity destruction temperature and the calculated maximum power generated per cm of conductive polyaniline fiber as a function of fiber diameter for conductive polymer fibers having the composition: $PANI.AMPSA_{0.20}.DCAA_{0.27}.(H_3PO_4)_{0.35}$.

For a particular fiber, the destruction current varies with temperature; higher temperatures requiring smaller currents to destroy the conjugated structure of the polymeric materials. Since the destruction current density is the same for the same types of fibers, higher destruction temperature will be obtained for fibers having larger diameters. The calculated relationship between the fiber diameter and the conductivity destruction temperature (in K), and the maximum power generated by 1 cm of fiber (mW/cm), when a constant voltage is applied under ambient conditions, are illustrated in FIG. 20 hereof for conductive polymer fibers having the composition: $PANI.AMPSA_{0.20}.DCAA_{0.27}.(H_3PO_4)_{0.35}$. In the calculations of these quantities, the destruction current density of is acquired from the experimental result shown in FIG. 14 and FIG. 15 hereof, and the temperature is calculated by using an $m_1$ value of 0.023 (see FIG. 4 hereof). The conductivity in the calculation is based on the experimental results illustrated in FIG. 1. It is seen that as the fiber diameter increases, the fibers are capable of delivering greater current before losing their conductivity. Therefore, conductivity destruction temperatures and generated power can varied by adjusting the fiber diameter; that is, the fiber conductivity destruction temperature can be "designed" by changing dopants and by varying the fiber diameter based on working temperature requirements. Additionally, the maximum power per unit length of conductive polymer fiber increases as the diameter of the fiber increases.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A heating apparatus comprising a heating element selected from the group consisting of conductive polyaniline fiber, conductive polyaniline yarn comprising conductive polymer fiber, fabrics comprising conductive polyaniline fiber or conductive polyaniline yarn, and non-conductive substrates supporting conductive polyaniline fiber or conductive polymer yarn, wherein said conductive polyaniline fiber comprises at least one dopant such that said conductive polyaniline fiber is characterized by an as-spun conductivity of ≧100 S/cm said conductive polyaniline fiber having a chosen diameter, and wherein the conductivity of said conductive polyaniline fiber is irreversibly destroyed at temperatures lower than the temperature at which said conductive polyaniline fiber loses said at least one dopant, or the temperature at which said at least one dopant decomposes, when a voltage or current greater than a voltage or current characteristic of the conductive polyaniline fiber is applied thereto by said means for passing a voltage or a current through said heating element; and means for passing a voltage or a current through said heating element.

2. The heating apparatus as described in claim 1, wherein said fabrics are selected from the group consisting of woven, knitted, stitched and braided fabrics.

3. The heating apparatus as described in claim 1, wherein structural integrity of said conductive polyaniline fiber is not significantly affected when the conductivity thereof is irreversibly destroyed as a result of the voltage or current characteristic of said conductive polyaniline fiber being applied thereto.

4. The heating apparatus as described in claim 1, wherein the temperature at which the conductivity of said conductive polyaniline fiber is irreversibly destroyed is determined by selecting the diameter of said conductive polyaniline fiber.

5. The heating apparatus as described in claim 1, wherein the temperature at which the conductivity of said conductive polyaniline fiber is irreversibly destroyed is determined by selecting said at least one dopant.

6. The heating apparatus as described in claim 1, wherein maximum power generated by a chosen length of said conductive polyaniline fiber is determined by selecting the diameter of said conductive polyaniline fiber.

7. The heating apparatus as described in claim 1, wherein maximum power generated by a chosen length of said conductive polyaniline fiber is determined by selecting said at least one dopant.

8. The heating apparatus as described in claim 1, wherein said at least one dopant is ion exchanged with a selected dopant.

9. The heating apparatus as described in claim 1, wherein said conductive polyaniline fiber is dedoped to remove said at least one dopant, and redoped with a selected dopant.

10. The heating apparatus as described in claim 1, wherein said heating element is generated from substantially non-conductive polyaniline fiber or yarn comprising substantially non-conductive polyaniline fiber, after which said heating element is doped with at least one dopant such that the substantially non-conductive polyaniline fiber is comprised of at least one dopant and said conductive polyaniline fiber is characterized by a conductivity of ≧100 S/cm.

11. A heating apparatus comprising in combination a conductive polyaniline fiber having at least one dopant and a chosen diameter, and characterized by an as-spun conductivity of ≧100 S/cm and an as-spun peak stress of ≧75 MPa, wherein the conductivity of said conductive polyaniline fiber is irreversibly destroyed at temperatures lower than the temperature at which said conductive polyaniline fiber loses said at least one dopant, or the temperature at which said at least one dopant is decomposed, when a voltage or current greater than a voltage or current characteristic of the fiber is applied thereto by said means for applying a voltage or a current to said fiber; and means for applying a voltage or a current to said fiber.

12. The heating apparatus as described in claim 11, wherein said conductive polyaniline fiber is further characterized by an as-spun modulus ≧1 GPa and an as-spun percent extension at fracture ≧10.

13. The heating apparatus as described in claim 11, wherein said fiber is generated from a solution comprising polyaniline, 2-acrylamido-2-methyl-1-propanesulfonic acid, dichloroacetic acid, and water.

14. The heating apparatus as described in claim 13, wherein said fiber is spun using polyaniline having a molecular weight of ≧200,000 g/mol.

15. The heating apparatus as described in claim 13, wherein said solution is caused to coagulate by placing said fiber in contact with a liquid selected from the group consisting of ethyl acetate and 2-butanone.

16. The heating apparatus as described in claim 14, wherein said fiber is placed in contact with phosphoric acid solution after being placed in contact with said liquid.

17. The heating apparatus as described in claim 13, wherein said 2-acrylamido-2-methyl-1-propanesulfonic acid is ion exchanged with a selected dopant.

18. The heating apparatus as described in claim 13, wherein said conductive polyaniline fiber is dedoped to remove said 2-acrylamido-2-methyl-1-propanesulfonic acid, and redoped with a selected dopant.

19. The heating apparatus as described above in claim 13, wherein said conductive polyaniline fiber is dedoped to remove said 2-acrylamido-2-methyl-1-propanesulfonic acid, and redoped with a selected dopant.

20. The heating apparatus as described in claim 11, wherein structural integrity of said fiber is not significantly affected when the conductivity thereof is irreversibly destroyed subsequent to the voltage or current characteristic of said fiber being applied thereto.

21. The heating apparatus as described in claim 11, wherein the temperature at which the conductivity of said conductive polyaniline fiber is irreversibly destroyed is determined by selecting said at least one dopant.

22. The heating apparatus as described in claim 11, wherein the temperature at which the conductivity of said conductive polyaniline fiber is irreversibly destroyed is determined by selecting the diameter of said conductive polyaniline fiber.

23. The heating apparatus as described in claim 11, wherein maximum power generated by a chosen length of said conductive polyaniline fiber is determined by selecting said at least one dopant.

* * * * *